US005303018A

United States Patent [19]

Terada et al.

[11] Patent Number: 5,303,018

[45] Date of Patent: Apr. 12, 1994

[54] COLOR ELECTROPHOTOGRAPHIC APPARATUS

[75] Inventors: Hiroshi Terada, Ikoma; Hajime Yamamoto, Ibaraki, both of Japan

[73] Assignee: Matsushita Electric Industrial Co., Ltd., Osaka, Japan

[21] Appl. No.: 79,881

[22] Filed: Jun. 23, 1993

[30] Foreign Application Priority Data

Jun. 24, 1992 [JP] Japan ..... 4-165828
Jul. 3, 1992 [JP] Japan ..... 4-176458

[51] Int. Cl.[5] ..... G03G 15/01

[52] U.S. Cl. ..... 355/326 R; 346/160; 355/210

[58] Field of Search ..... 355/326, 327, 200, 210, 355/245, 271, 228, 260; 346/153.1, 160

[56] References Cited

U.S. PATENT DOCUMENTS

| | | | |
|---|---|---|---|
| 3,797,930 | 3/1974 | Tanaka et al. | 355/326 |
| 3,985,435 | 10/1976 | Suzuki et al. | 355/327 |
| 4,162,843 | 7/1979 | Inoue et al. | 355/327 |
| 4,531,828 | 7/1985 | Hoshino | 346/160 |
| 4,610,529 | 9/1986 | Koizumi | 355/327 |
| 4,809,037 | 2/1989 | Sato | 346/160 |
| 4,893,179 | 1/1990 | Ito | 355/327 X |
| 4,905,048 | 2/1990 | Suzuki . | |
| 4,935,788 | 6/1990 | Fantuzzo et al. | 355/326 |
| 5,081,506 | 1/1992 | Borostyan . | |
| 5,083,164 | 1/1992 | Kamath et al. | 355/245 |
| 5,160,946 | 11/1992 | Hwang | 355/327 X |

FOREIGN PATENT DOCUMENTS

| | | |
|---|---|---|
| 0515053 | 11/1992 | European Pat. Off. . |
| 0552410 | 7/1993 | European Pat. Off. . |
| 1-252982 | 10/1989 | Japan . |
| 2-16580 | 1/1990 | Japan . |

OTHER PUBLICATIONS

Patent Abstracts of Japan; vol. 12, No. 178 (P-708) May 26, 1988.

*Primary Examiner*—A. T. Grimley
*Assistant Examiner*—Sandra L. Brasé
*Attorney, Agent, or Firm*—Wenderoth, Lind & Ponack

[57] ABSTRACT

A color electrophotographic apparatus arranged as follows is disclosed. A plurality of image forming units (1BK, 1C, 1M, 1Y) each including a developing device having an electrostatic latent image holding member and toner of a different color are employed. Each of the image forming units is arranged to be displaceable so as to be moved to the same image forming position for positioning. At the image forming position, the image forming unit is exposed to light image by an exposure device for image formation, with its toner image being transferred onto a transfer material through a confronting transfer transport device. The image forming unit at the image forming position is sequentially exchanged, and by the reciprocation of the transfer material through the transfer/transport device, toner images of respective colors are transferred as overlapped through positioning for coincidence, onto the same transfer material.

17 Claims, 14 Drawing Sheets

COLOR ELECTROPHOTOGRAPHIC APPARATUS

BACKGROUND OF THE INVENTION

1. Field of the Invention

The present invention generally relates to electrophotography, and more particularly, to a color electrophotographic apparatus which may be applied to a color copying apparatus, color printer or the like.

Generally, for forming a color image by electrophotography, it has been a practice to form a color image by overlapping toner images of yellow, magenta, cyan and black respectively on a transfer material. As the method for effecting the overlapping of such toner images over the transfer material, there have been generally employed a transfer drum system in which the transfer material wound on a transfer drum is rotated and repeatedly brought into the same image forming position, whereat toner images of respective colors successively formed are overlapped for transfer, and a continuous transfer system wherein a plurality of image forming sections are disposed side by side, and the transfer material transported by a transport belt or the like is caused to pass through the transfer position of each image forming section, thereby to successively transfer and overlap the toner image of the respective colors to obtain the colored image.

One example of color image forming apparatuses employing the former transfer drum system is disclosed, for example, in Japanese Patent Laid-Open Publication Tokkaihei No. 1-252982, which will be referred to as a prior art (1) hereinafter.

Referring to FIG. 16, general construction and function of the color image forming apparatus of the prior art (1) will be briefly explained.

In FIG. 16, the conventional color image forming apparatus includes a housing H, and a photosensitive drum 201 having a photosensitive material layer provided on its outer peripheral surface, and rotatably provided at generally a central portion of the housing H. Around the photosensitive drum 201, there are sequentially disposed various processing devices such as a corona charger 202, a developing section 203, a transfer drum 204, and a cleaner 205, etc. The developing section 203 further includes a Y developing unit 206 for forming a yellow toner image, an M developing unit 207 for forming a magenta toner image, a C developing unit 208 for forming a cyan toner image, and a K developing unit 209 for forming a black toner image, which are arranged to rotate so that the respective developing units may be successively brought into a position confronting the photoreceptor drum 201 at which the developing may be effected During functioning, the transfer drum 204 and the photosensitive drum 201 confronting each other are rotated in directions indicated by arrows at constant speeds.

In the first place, upon starting of the functioning, the photosensitive drum 201 is rotated in the direction of the arrow, and the photosensitive surface thereof is uniformly charged by the corona charger 202. Thereafter, a laser beam BM modulated by a signal for forming a first yellow image is projected as shown by a chain line onto the surface of the photosensitive drum 201 so as to form an electrostatic latent image thereon, which is further developed by the developing unit 206 for yellow initially confronting said photosensitive drum 201, and thus, the yellow toner image is formed. By the time when the yellow toner image thus formed arrives at the position confronting the transfer drum 204, a copy paper sheet as a transfer material (not particularly shown) fed from a paper feeding section 211 has already been wound on the outer periphery of the transfer drum 204, with the leading edge of the copy paper sheet being grasped by a claw portion 212, and timing is so arranged that the yellow toner image on the photosensitive drum 201 confronts and meets a predetermined position of the copy paper sheet, thereby to from the toner image.

After the yellow toner image on the photosensitive drum 201 has been transferred onto the copy paper sheet by the action of the transfer charger 213, the photosensitive surface of the drum 201 is cleaned by the cleaner 205 to prepare for the image formation in the subsequent color. Sequentially, the magenta, cyan, and black toner images are formed in the similar manner, and in such case, the developing section 203 causes each of the respective developing units used according to the colors, to confront the photosensitive drum 201 so as to be ready for the development. The transfer drum 204 has a diameter sufficient to wind a copy paper sheet of the maximum length therearound, and also, to provide enough time to allow exchange of the developing units between images of the respective colors.

The projection of the laser beam BM for the image formation of the respective colors is so timed that the toner image of each color on the photosensitive drum 201 and the toner image already transferred onto the copy paper sheet on the transfer drum 204 confront each other, with positional coincidence as the drums 201 and 204 rotate. Thus, the toner images of four colors are transferred in the overlapped state onto the copy paper sheet on the transfer drum 204, and thus, the color image is formed on the copy paper sheet. After the toner images of all colors have been transferred, the copy paper sheet is separated from the transfer drum 204 by a separating claw 214, and fed through a transport section 215, to a fixing device 216 so as to be fixed with the above toner image, and then, discharged out of the apparatus.

Meanwhile, another example of color electrophotographic apparatuses based on the latter continuous transfer system is disclosed, for example, in Japanese Patent Laid-Open Publication Tokkaihei No. 2-16580, which will be referred to as a prior art (2) hereinafter.

FIG. 17 shows a printer portion which is an image forming section of the copying apparatus disclosed in the above Tokkaihei No. 2-16580 as the prior art (2).

In the arrangement of FIG. 17, four image forming sections 222BK, 222C, 222M and 222Y respectively having photosensitive drums 223BK, 223C, 223M and 223Y, and exposure devices 221BK, 221C, 221M and 221Y, etc. for the image formation in four colors are aligned side by side, and a copy paper sheet transported by a transport belt 227 passes through respective transfer sections for the photosensitive drums so as to be overlapped with the toner images. Digital signals sent from an image reading section (not shown) are applied to the printer section, and fed to the laser exposure devices of respective color signals, i.e., 221BK for black, 221C for cyan, 221M for magenta, and 221Y for yellow. Since each of the image forming sections 222 has similar construction, only the image forming section 222C for cyan will be described hereinbelow, and like parts in other image forming sections being designated by like reference numerals with suffixes of respective colors for brevity of explanation.

The image forming section 222C has the photosensitive drum 223C besides the exposure device 221C, and around said photosensitive drum 223C, there are sequentially disposed a corona charger 224C, a developing device 225C, a transfer charger 226C, etc. in the known manner as in a conventional electrophotographic copying apparatus. The photosensitive surface of the photosensitive drum 223C uniformly charged by the corona charger 224C is formed with an electrostatic latent image for the cyan image through exposure by the exposure device 221C, and the latent image is developed into a visible toner image by the developing device 225C. The copy paper sheet (not particularly shown) transported by a transfer belt 227 is successively fed to the photosensitive drums 223BK, 223C, 223M and 223 Y respectively formed with the visible toner images of the respective colors, and is transferred with the toner images by the action of the transfer charger 226, whereby a full color image is obtained on the transfer sheet.

Furthermore, as another method for forming a color image by overlapping toner images of different colors on a transfer material, U.S. Pat. No. 4,905,084 discloses a method for overlapping toner images by repeating transfer through reciprocating displacement of the transfer material with respect to a photosensitive material.

In the conventional arrangements as described above, by the transfer drum system of the prior art (1), the transfer drum is employed for positioning and overlapping toner images of different colors. By rotating the transfer drum at the same speed with respect to the photosensitive drum, and further, by coinciding timing thereof with respect to the leading edge of the image, mutual positions of the toner images in the respective colors are registered in the case where the color image is to be formed.

In the known arrangement as described above, however, the copy paper sheet must be wound onto the transfer drum, requiring the diameter of the transfer drum to be larger than a predetermined size, with the construction thereof being very complicated, and thus, the apparatus tends to be on a large scale. Moreover, tough or hard paper such as a post card, cardboard or the like can not be employed, since such paper is difficult to be wound onto the transfer drum.

On the other hand, in the continuous transfer system as in the prior art (2) in FIG. 17, since the image forming positions corresponding to the number of colors are provided and the copy paper sheet is only required to successively pass therethrough, the transfer drums are not necessary. However, in this case, due to the fact that the image forming positions equal to the number of colors are required, the exposure means for exposing images onto the photosensitive drum is necessary by the number of colors, and thus,. cost of the apparatus is undesirably increased. Moreover, in the above arrangement, as is also disclosed in Japanese Patent Laid-Open Publication Tokkaihei No. 1-250970, high accuracy is required for the positioning of the respective colors of the exposure devices, and thus, particular structure and complicated arrangements are necessary for the image exposure system. Further, since the image forming positions are present separately at a plurality of places, positioning of respective colors on the transfer material also becomes difficult, and together with the difficulty in the positioning for the exposure devices as described earlier, color shift or deviation tends to be large.

Additionally, in the arrangement disclosed in U.S. Pat. No. 4,905,048 referred to earlier in which the transfer material is reciprocatingly displaced, since the intersection of the developing section with the belt is prevented so that toner images in various colors may be formed on one photosensitive member, there have been such problems that (1) the size of the photosensitive member tends to be large, (2) a spacing/contacting mechanism between the photosensitive member and belt is required in addition to the change-over mechanism of the developing units for respective colors, thus complicating the construction and control therefor, and (3) maintenance work for the replacement, etc. of such mechanisms also becomes complicated.

2. Description of the Prior Art

SUMMARY OF THE INVENTION

Accordingly, an essential object of the present invention is to provide a color electrophotographic apparatus which is capable of accurately effecting positioning of colors through compact and simple constructions without requiring transfer drums of complicated structure or complicated arrangements for positioning of an image exposure system.

Another object of the present invention is to provide a color electrophotographic apparatus of the above described type which can produce color images at high image quality with less speed variation during image formation through a simple construction.

A further object of the present invention is to provide a color electrophotographic apparatus of the above described type which is compact in size as a whole in spite of increase in the capacity of a developing material hopper of each image forming unit, while the construction of the image forming unit including a photosensitive drum and developing unit is simple for easy replacement.

In accomplishing these and other objects, according to one aspect of the present invention, there is provided a color electrophotographic apparatus which includes a plurality of movable image forming means each provided with a rotatable electrostatic latent image holding member and a developing means each having toner of different color, and capable of forming toner image of different color on said electrostatic latent image holding member, a transfer and transport means capable of supporting thereon a transfer material so as to reciprocatingly move said transfer material, and provided with a transfer means for transferring the toner image on said electrostatic latent image holding member onto the transfer material at a single transfer position, an exposure means for effecting image exposure at a single exposure position corresponding to said transfer position, a displacing means for successively displacing each of said plurality of image forming means to an image forming position corresponding to said exposure position and also to said transfer position, and a positioning means for positioning said image forming means which has moved to said image forming position, whereby the toner images of different colors are overlapped on the transfer material, with positions thereof aligned, thereby to effect the color image formation.

In another aspect of the present invention, the color electrophotographic apparatus includes a plurality of movable image forming means each provided with a rotatable electrostatic latent image holding member and a developing means each having toner of different color, and capable of forming a toner image of different color on said electrostatic latent image holding member, a transfer and transport means capable of supporting thereon a transfer material so as to reciprocatingly move said transfer material, and provided with a transfer means for transferring the toner image on said electrostatic latent image holding member onto the transfer material at a single transfer position, an exposure means for effecting image exposure at a single exposure position corresponding to said transfer position, a displacing means for successively displacing each of said plurality of image forming means to the vicinity of an image forming position corresponding to said exposure position and also to said transfer position, and a positioning means for positioning said image forming means which is in the vicinity of said image forming position by displacing said image forming means to said image forming position, whereby the toner images of different colors are overlapped on the transfer material, with positions thereof aligned, thereby to effect the color image formation.

In still another aspect of the present invention, the color electrophotographic apparatus includes a plurality of movable image forming means each provided with a rotatable electrostatic latent image holding member and a developing means each having toner of different color, and capable of forming a toner image of different color on said electrostatic latent image holding member, a support means for supporting said plurality of image forming means, a transfer means for transferring the toner image on said electrostatic latent image holding member onto the transfer material at a single transfer position, an exposure means for effecting image exposure at a single exposure position corresponding to said transfer position, a displacing means for displacing said support means so that each of said plurality of image forming means successively approaches an image forming position corresponding to said exposure position and also to said transfer position, and a positioning means for positioning said image forming means which has approached said image forming position, whereby the toner images of different colors are overlapped on the transfer material, with positions thereof aligned, thereby to effect the color image formation.

In a further aspect of the present invention, the color electrophotographic apparatus includes a plurality of movable image forming means each provided with a rotatable electrostatic latent image holding member and a developing means each having toner of different color, and capable of forming a toner image of different color on said electrostatic latent image holding member, a transfer and transport means capable of supporting thereon a transfer material so as to reciprocatingly move said transfer material, and provided with a transfer means for transferring the toner image on said electrostatic latent image holding member onto the transfer material at a single transfer position, a flywheel means which can be selectively connected to and spaced from said transfer and transport means, an exposure means for effecting image exposure at a single exposure position corresponding to said transfer position, a displacing means for successively displacing each of said plurality of image forming means to an image forming position corresponding to said exposure position and also to said transfer position, whereby the toner images of different colors are overlapped on the transfer material, with positions thereof aligned, thereby to effect the color image formation.

In a still further aspect of the present invention, the color electrophotographic apparatus includes a plurality of movable image forming means each provided with a rotatable photosensitive member and a developing means each having toner of different color, and capable of forming a toner image of different color on said photosensitive member, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position corresponding to said exposure position and also, to said transfer position, whereby the toner images of different colors are overlapped on the transfer material, with positions thereof aligned, thereby to effect the color image formation by fixing the color image on said transfer material by a heat fixing means, said plurality of image forming means being disposed in such an order that the image forming means for black is disposed in a position closest to the side of the heat fixing means in the horizontal direction.

In another aspect of the present invention, the color electrophotographic apparatus includes a plurality of movable image forming means each provided with a rotatable photosensitive member, a charger for charging said photosensitive member, a developing material hopper for storing toner in different color, a developing means for developing said photosensitive member by said toner, and a cleaner for cleaning said photosensitive member, thereby to form toner images in different colors respectively on said photosensitive members, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position corresponding to said exposure position and also, to said transfer position, whereby the toner images of different colors are overlapped and transferred on the transfer material for color image formation, thereby to obtain the color images on said transfer material, part of said developing material hopper of said image forming means being arranged to utilize a space at the upper part of said charger of the neighboring image forming means.

In still another aspect of the present invention, the color electrophotographic apparatus includes a plurality of movable image forming means each provided with a rotatable photosensitive member, a charger for changing said photosensitive member, a developing material hopper for storing toner in different color, a developing means for developing said photosensitive member by said toner, and a cleaner for cleaning said photosensitive member, thereby to form toner images in different colors respectively on said photosensitive members, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position, corresponding to said exposure position and also to said transfer position, whereby the toner images of different colors are overlapped and transferred on the transfer material for color image formation, thereby to obtain the color images on said transfer material, part of said developing material hopper of said image forming means being arranged to utilize a space at the upper part of said cleaner of the neighboring image forming means.

In a further aspect of the present invention, the color electrophotographic apparatus includes a plurality of movable image forming means each provided with a rotatable photosensitive member and a developing means each having toner of different color, and capable of forming a toner image of different color on said photosensitive member, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position, corresponding to said exposure position and also to said transfer position, whereby the toner images of different colors are overlapped and transferred onto the transfer material, thereby to effect the color image formation for obtaining color image on said transfer material, said neighboring color forming means being each formed into a shape which can be taken out slantwise upwardly. According to the color electrophotographic apparatus of the present invention as described above, favorable effects as follows can be achieved.

Since the color image formation may be effected onto the transfer sheet on the transfer belt having a comparatively simple construction without employing the transfer section having the complicated structure as in the conventional transfer drum, reliability for the paper sheet transport can be improved by the simple construction of the apparatus.

As compared with the apparatus of the continuous transfer system having four image forming positions, owing to the arrangement of the present invention to effect image formation of each color by positioning all the image forming means at the same position, not only the construction of the exposure device, etc. is simplified, but the positioning of the color images can be accurately effected.

By the displacement of the image forming means, spacing of the photosensitive material from the belt during returning movement thereof may be simultaneously effected with the exchange of colors, it is not necessary to separately provide the mechanism for the color exchange and the spacing and contact mechanism between the belt and the photosensitive material. Therefore, the image forming means is simple in construction, and superior in the aspect of maintenance, for example, in that the image forming means can be independently replaced for each color. Although problems related to scattering of toner and developing material tend to occur during spacing or contact between the developing unit and the photosensitive material, since the image forming means in the present invention constitutes the independent image forming unit for each color, troubles such as spilling of toner, etc. do not readily take place when the image forming unit of each color is displaced to the image forming position.

Moreover, since the flywheel is controlled so as to be spaced from or contact the transfer and transport means, beautiful color images small in the speed variation may be formed during the image formation.

Even in the color electrophotographic apparatus, only the black toner tends to be used most frequently in the printing of documents, etc., and in this case, if the black image forming unit is disposed at the leftmost end of the row of four image forming units, the color units other than the black unit are disposed at positions spaced from the fixing device which is a heat source, and therefore, even when printing of many sheets continue for a long period of time, occurrence of a trouble such as aggregation of toner, etc. due to influence of heat on the other color units may be prevented. Additionally, if the black image forming unit which may be most frequently used singly is disposed at the image forming position during the stand-by period of the image forming operation, not only the other color units are protected against troubles by heat, but time required up to the printing function starting may be advantageously reduced, whereby when the color electrophotographic apparatus is used for printing in black alone, performance not inferior to the general white and black electrophotographic apparatuses can be achieved.

If the space above the corona charger, which normally becomes a wasteful space not utilized at all, is used as the space for collecting the developing material of the neighboring image forming unit, such space is effectively utilized to the maximum degree without changing the size of the group of the image forming units as a whole, when the four image forming units are disposed side by side. In this case, if each of the image forming units is formed to have a side face configuration which allows withdrawal thereof slantwise upwardly, for example, a parallelogram shape, one image forming unit may be singly drawn out from the row of the four image forming units, and this provides a superior effect in the aspect of maintenance when the image forming means is to be exchanged for each color. dr cl BRIEF DESCRIPTION OF THE DRAWINGS These and other objects and features of the present invention will become apparent from the following description taken in conjunction with the preferred embodiment thereof with reference to the accompanying drawings, in which;

FIG. 1 is a schematic side sectional view showing construction of a color electrophotographic apparatus according to a first embodiment of the present invention, FIG. 2 is a schematic side sectional view showing on an enlarged scale, an image forming unit which is employed in the color electrophotographic apparatus of FIG. 1, FIG. 3 is a perspective view showing the state where the image forming unit of the color electrophotographic apparatus in FIG. 1 is to be drawn out of the apparatus, FIG. 4 is a fragmentary side elevational view for explaining positioning of the image forming units for the color electrophotographic apparatus of FIG. 1, FIG. 5 is also a fragmentary side elevational view of the image forming unit of FIG. 4 as observed in the direction of an arrow V in FIG. 4, FIG. 6 is a perspective view showing construction of a driving section for a transfer/transport belt for the color electrophotographic apparatus of FIG. 1, FIG. 7 is a schematic side sectional view showing construction of a color electrophotographic apparatus according to a second embodiment of the present invention, FIG. 8 is a schematic side sectional view of an image forming unit for a first example which may be employed in the color electrophotographic apparatus of FIG. 7, FIG. 9 is a schematic side sectional view of an image forming unit for a second example which may be employed in the color electrophotographic apparatus of FIG. 7, FIG. 10 is a schematic side sectional view of an image forming unit for a third example which may be employed in the color electrophotographic apparatus of FIG. 7, FIG. 11 is a fragmentary side elevational view for explaining positioning of the image forming units for the color electrophotographic apparatus of FIG. 7, FIG. 12 is also a fragmentary side elevational view of the image forming unit of FIG. 11 as observed in the direction of an arrow J in FIG. 11, FIG. 13 is a schematic side sectional view showing construction of a color electrophotographic apparatus according to a third embodiment of the present invention, FIG. 14 is a schematic side sectional view of an image forming unit which is employed in the color electrophotographic apparatus of FIG. 13, FIG. 15 is a timing-chart during formation of a color image in A4 size by the color electrophotographic apparatus of FIG. 1, FIG. 16 is a schematic side sectional view showing construction of a conventional color electrophotographic apparatus for a prior art 1 (already referred to), and FIG. 17 is a schematic side sectional view showing construction in a printer section i.e., image forming section of a conventional color electrophotographic apparatus for a prior art 2 (already referred to).

DETAILED DESCRIPTION OF THE INVENTION

Figure 1:
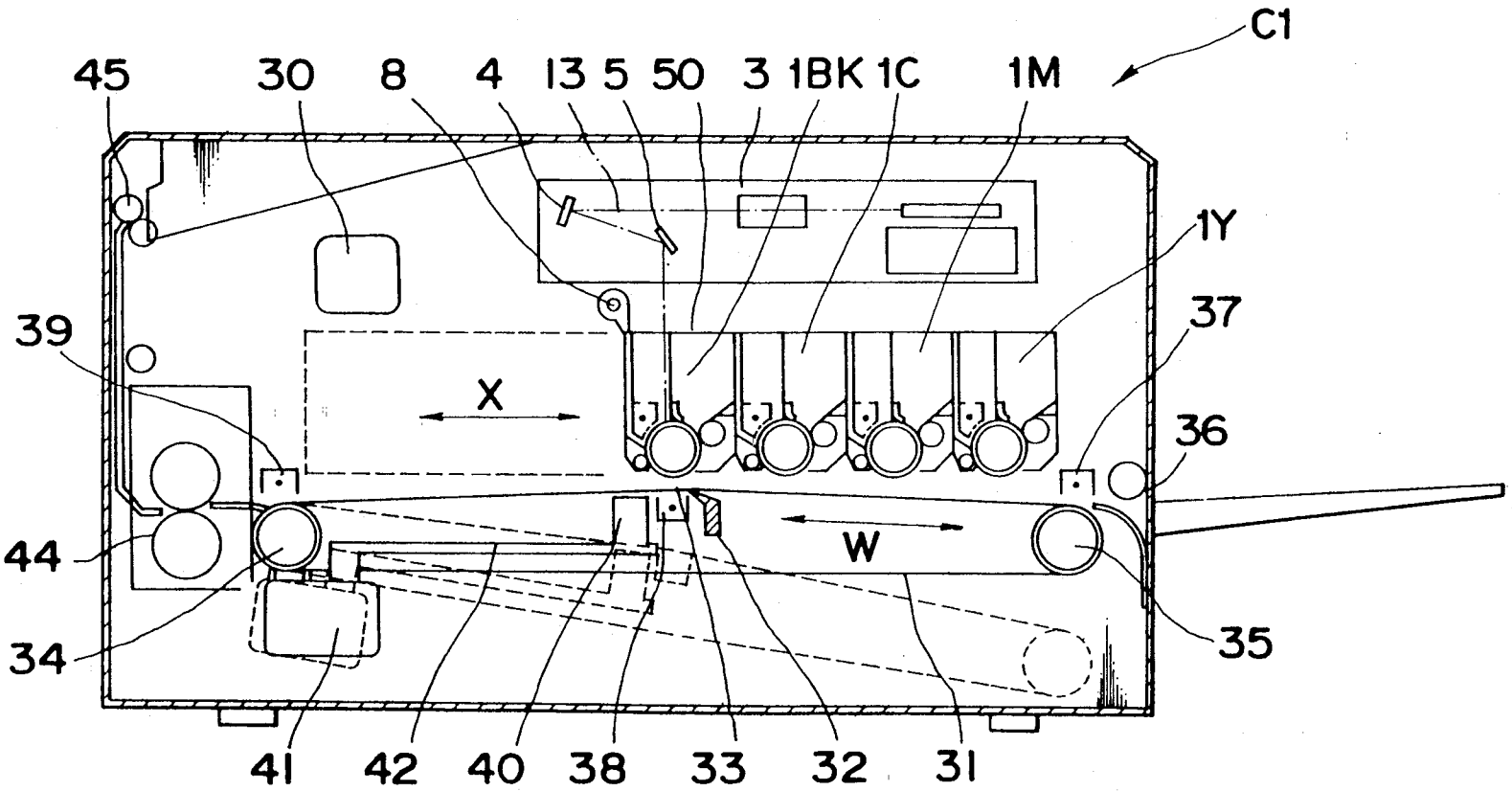

Before the description of the present invention proceeds, it is to be noted that like parts are designated by like reference numerals throughout the accompanying drawings.

Referring now to the drawings, embodiments of a color electrophotographic apparatus according to the present invention will be described hereinbelow.

In the first place, it is to be noted here that, for a photosensitive material to be used in the present invention, zinc oxide, selenium, cadmium sulfide, amorphous silicone, and further, organic photosensitive materials utilizing phthalocyanine, azo pigment or the like may be employed.

Meanwhile, a two-component developing material composed of toner and magnetic carrier can be used for the present invention. The toner employed for the present invention is obtained by dispersing coloring pigments such as carbon black and phthalocyanine, etc. in a binder resin for example, of acrylic resin, polyester or the like for subsequent classification after grinding, and may be in the form of a powder obtained by spray drying or chemically composed of a pearl polymerization, emulsion polymerization or the like. Moreover, the toner particles may be mixed onto carrier as they are or they may be mixed after causing silica fine particles or fluororesin powder to adhere on the surfaces thereof. Although the average particle diameter of the toner particles to be employed should preferably be under 15 μm, sharper images may be obtained if the particle diameter is below 12 μm. The carrier to be employed for the present invention is a magnetic powder or the like obtained by dispersing fine particles of a magnetic material such as an iron powder, ferrite powder, or a powder prepared by coating the surfaces thereof by resin, or fine particles of ferrite powder, magnetite, etc., into styrene resin, epoxy resin, styrene acrylic resin, etc., at a ratio of about 30 to 80% for mixing, with subsequent grinding and classification. The average particle diameter of the carrier should preferably be less than 300 μm, and particularly, if reduced below 150 μm, the toner may be uniformly charged.

Specific embodiment 1

Subsequently, the color electrophotographic apparatus according to a first embodiment of the present invention will be described with reference to the drawings.

In FIG. 1, there is shown a color electrophotographic apparatus C1 according to a first embodiment of the present invention mainly with respect to a printer section thereof for the image formation.

In the first place, at the printer section, image forming units 1BK, 1C, 1M, and 1Y as four sets of image forming means for black, cyan, magenta and yellow are disposed side by side. Since the respective image forming units are constituted by the same members except for the developing materials accommodated therein, description will be given only with respect to the image forming unit 1M for magenta, and description for other image forming units is omitted for brevity of explanation, with like parts being designated by like reference numerals, and in the case where it is necessary to distinguish the construction of the unit for each color, symbols representing respective colors will be affixed to numerals.

Figure 2:
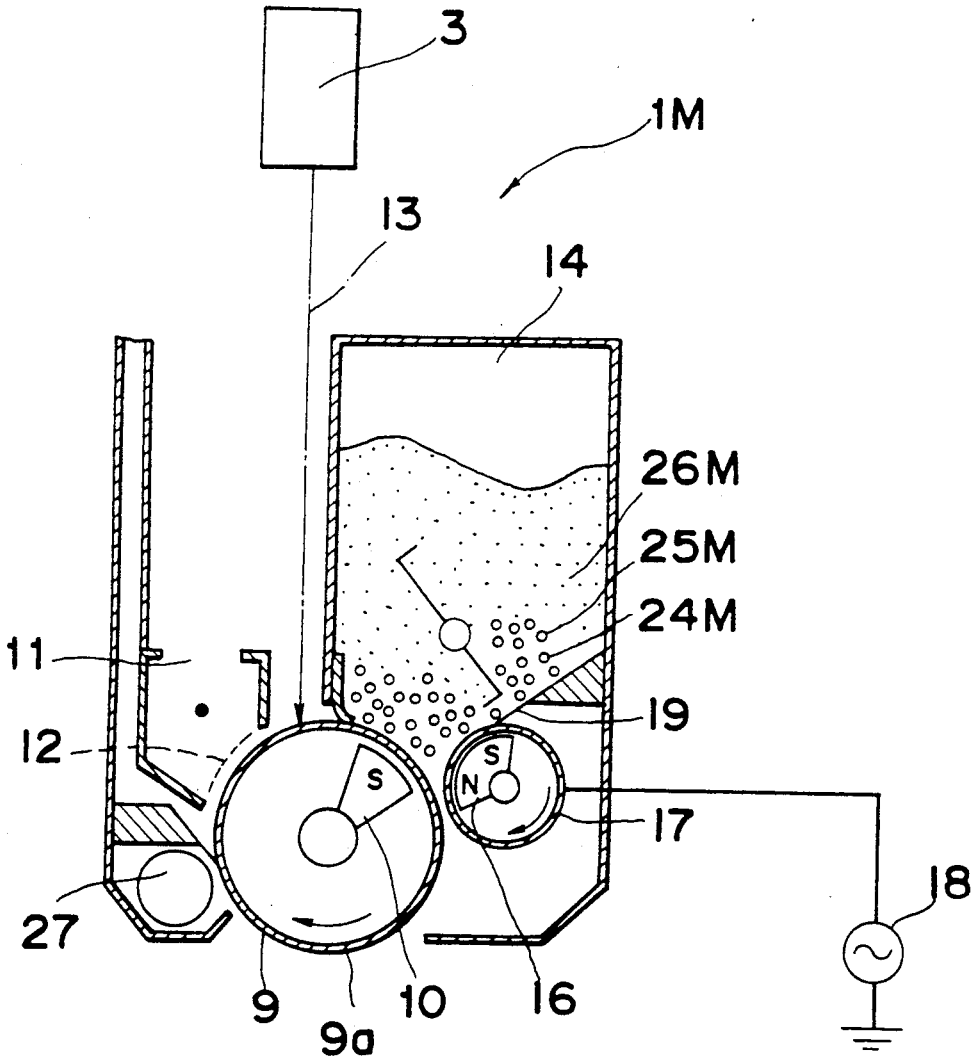

FIG. 2 shows the construction of the image forming unit 1M for magenta in detail.

The image forming unit 1M includes a developing material hopper 14 containing a two-component developing material 26M, a photosensitive drum 9 having an organic photosensitive layer 9*a* on its outer peripheral surface and rotatably provided at the lower portion of the hopper 14, and a magnet 10 fixedly mounted on a shaft for rotatably supporting the photosensitive drum 9. It is to be noted that although the photosensitive drum 9 is rotated around said shaft, the magnet 10 is fixed together with said shaft. Around the photosensitive layer 9*a*, there are sequentially disposed various processing devices such as a corona charger 11 for negatively charging the photosensitive layer 9*a* through a grid electrode 12 for controlling charge potential of the photosensitive layer 9*a* to be subjected to a laser beam scanning light 13, a collecting electrode roller 17 of aluminum rotatably provided adjacent to the photosensitive drum 9 and connected to an A.C. high voltage source 18 so as to be applied with a voltage thereby, an unrotatable magnet 16 coaxially fixed within said collecting electrode roller 17, a scraper 19 of a polyester film provided to scrape off toner on the surface of the roller 17, and a cleaner 27 for cleaning toner remaining on the photosensitive layer 9*a* after transfer.

The organic photosensitive material layer 9*a* is prepared by dispersing phthalocyanin into polycarbonate group binder resin. The two-component developing material 26M is produced by mixing ferrite carrier 24M with particle diameter of 50 μm coated on the surface by silicone, and toner 25M for attraction onto the surface of the photosensitive layer 9*a* by a magnetic force, while the toner 25M is prepared by dispersing a pigment in a polyester resin, with further addition of an additive thereto.

Magnetic flux densities on the surface of the photosensitive material layer 9*a* and the collecting electrode roller 17 are respectively 800 gauss at maximum positions. The photosensitive drum 9 has a diameter of 30 mm and is rotated in a direction indicated by an arrow at a circumferential speed of 120 mm/sec., while the collecting electrode roller 17 has a diameter of 16 mm, and is rotated in a direction of an arrow at a circumferential speed of 100 mm/sec.

By the above arrangement, the photosensitive layer 9*a* of the photosensitive drum 9 was charged to −500 V by the corona charger 11, with an applied voltage at 31 5 kV, and a voltage for the grid 12 at −500 V. The laser beam scanning light 13 was projected onto the photosensitive layer 9*a* thus charged, thereby to form an electrostatic latent image thereon. At this time, the exposure potential for the photosensitive layer 9*a* was −100 V.

Onto the surface of the photosensitive layer 9*a*, the two-component developing material 26M was caused to adhere within the developing material hopper 14 by the magnetic force. Subsequently, the photosensitive layer 9*a* was passed before the electrode roller 17 through rotation of the photoreceptor drum 9. During passing of the uncharged region of the photosensitive layer 9, an A.C. voltage (frequency 1kHz) of 750 Vo-p (peak to peak 1.5 kV) superposed with a D.C. voltage of 0 V was applied to the electrode roller 17 by the A.C. high voltage source 18. Thereafter, during passing of the photosensitive layer 9*a* charged to −500 V and written with the electrostatic latent image, an A.C. voltage (frequency 1kHz) of 750 Vo-p (peak to peak 1.5 kV) superposed with a D.C. voltage of −350 V was applied to the electrode roller 17 by the A.C. high voltage source 18. Then, the toner attracted onto the carrier and the charged portion on the photosensitive layer 9*a* was collected by the electrode roller 17, and the, toner image subjected to negative-positive inversion only at image portion was left on the photosensitive layer 9*a*. The carrier and toner adhering to the electrode roller 17 rotating in the direction of the arrow was scraped off by the scraper 19 and returned into the developing material hopper 14 again for use in the subsequent image formation.

In the manner as described so far, the toner image in the magenta color is obtained on the photosensitive surface 9*a*.

Each of the image forming units 1BK, 1C and 1Y other than the unit 1M also has a similar constructions and functions as described so far.

Referring back to FIG. 1, the construction of the printer section will be described hereinbelow.

The image forming units 1BK, 1C, 1M and 1Y disposed side by side are supported by a first support member 47 (not shown in FIG. 1) to be described later with reference to FIG. 2, and is displaceable as a whole in lateral directions (in the directions indicated by arrows X) by a motor 30 as a displacing means, and each of the image forming units 1BK to 1Y may be sequentially positioned in the vicinity of an image forming position 50 where the image forming unit 1BK is located in FIG. 1. This position confronts the transfer section 33 generally at a central portion of the transfer/transport belt 31. At the transfer section 33, the transfer/transport belt 31 is somewhat raised by a belt restricting member 32 as compared with other flat portion thereof, and is accurately restricted in its position.

Constructions and functions for displacing the image forming units and positioning thereof at the image forming position will be described hereinafter with reference to FIGS. 3, 4 and 5.

Figure 3:
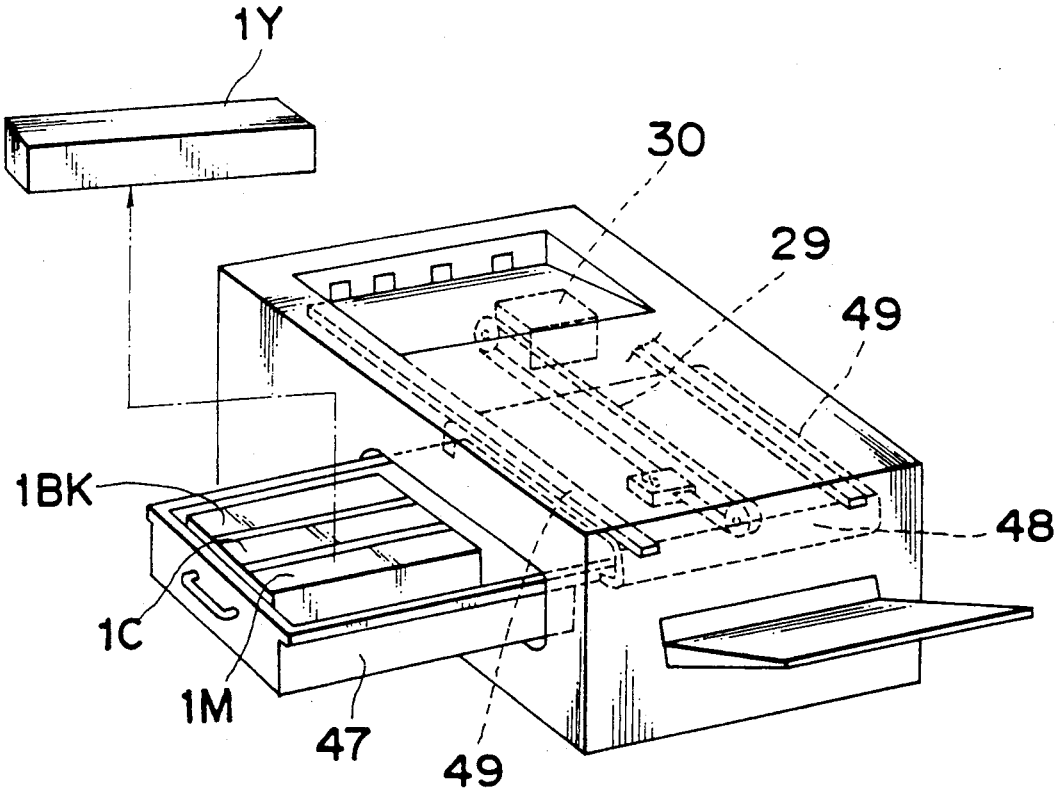

As shown in FIG. 3 for explaining the state of the image forming units during exchange, the first support member 47 as the support means for supporting the group of the image forming units 1BK to 1Y is arranged to be movable in a direction of depth of the apparatus by being guided through rail portions for a second support member 48 which supports said first support member 47, and FIG. 3 shows the state where the first support member 47 has been drawn out of the apparatus for maintenance. During the normal functioning, said first support member 47 is in a state where it is pushed into the apparatus, and in this state, the second support member 48 is displaceably supported by rail 49 fixed to the apparatus main body for displacement in a lateral width direction of the apparatus along said rail 49. Moreover, the second support member 48 is coupled with part of a belt 29 driven by the motor 30 so as to be moved reciprocatingly. Thus, the respective image forming units 1BK to 1Y are adapted to successively approach the image forming position.

Figure 4:
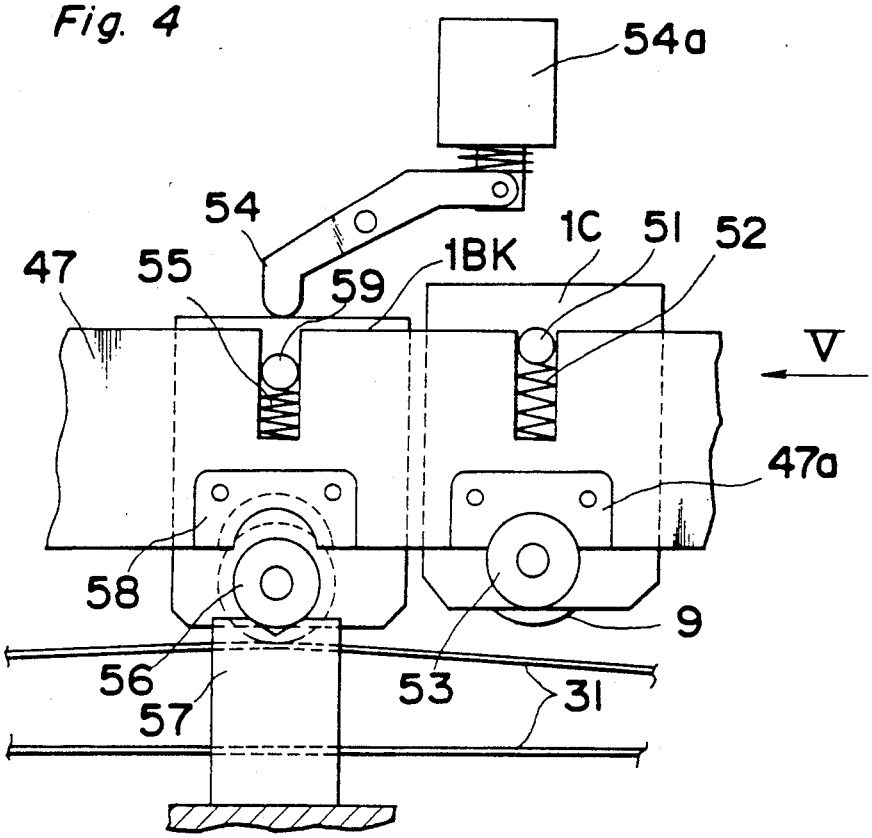
Figure 5:
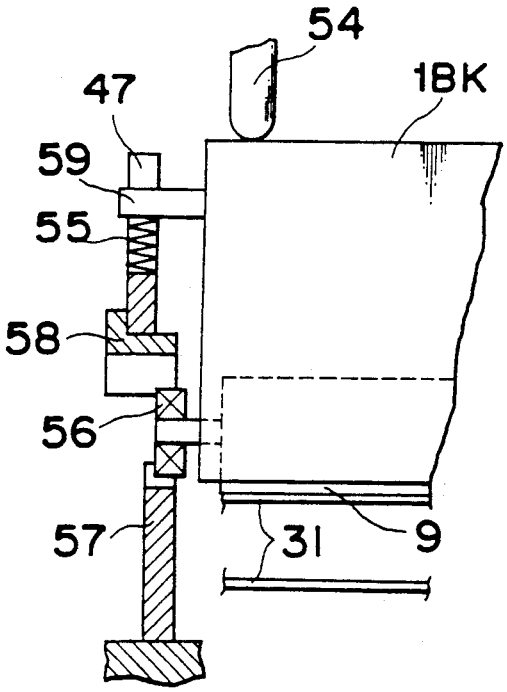

FIGS. 4 and 5 show an arrangement for positioning the image forming unit coming close to the image forming position. FIG. 4 shows the state where the black image forming unit 1BK is positioned at the image forming position.

As shown in FIG. 4 by the image forming unit 1C for cyan, in the image forming unit under the state where it is not positioned, a pin 51 provided on the image forming unit 1C is depressed by a spring 42 so as to be urged upwardly with respect to the first support member 47, while a bearing 53 provided in the image forming unit coaxially with the rotary axis of the photosensitive drum 9 is engaged with a support frame 47*a* provided in the first support member 47, and therefore, the image forming unit 1C is in the state where it is fixed to the first support member 47 as one unit. Meanwhile, the image forming unit 1BK positioned at the image forming position is depressed by a depressing lever 54 actuated by a solenoid 54*a* from above so as to be displaced downwardly against a spring 55, and a bearing 56 is engaged with a positioning member 57 having a V-shaped groove. The positioning member 57 is fixed to the apparatus main body, and receives the image forming unit at the predetermined position at all times. A fragmentary side sectional view in FIG. 5 shows the above state as observed in a direction indicated by an arrow V, in which Numeral 59 represents a pin provided in the image forming unit 1BK and urged by a spring 55, and the bearing 56 is spaced from the support frame 58, and is engaged with the V-shaped groove of the positioning member 57.

It is to be noted here that in the above embodiment, the bearing 58 is adapted to be positioned, but the arrangement may, for example, be so modified that the outer peripheral portion of the photosensitive drum is directly positioned by a bearing or the like, and in this case, influence due to eccentricity of the photosensitive drum, etc. may be further eliminated.

Referring back to FIG. 4, with respect to the image forming unit 1BK thus positioned, the position of the rotational center for the photosensitive drum is accurately determined by the positioning member 57, while the position of the entire image forming unit is determined by this rotational center and the pin 59. Accordingly, even when the position of the first support member 47 is deviated upwardly or downwardly or leftwardly or rightwardly to a certain extent from the position corresponding to the image forming position, only the orientation of the image forming unit is varied, and the rotational center of the photosensitive drum is correctly positioned at all times. As stated later, this is important since the position of the rotational center of the photosensitive drum affects the positioning of colors, and the orientation of the entire image forming unit has no influence thereon.

Described so far are the constructions and functions for the positioning of the image forming units.

Referring back to FIG. 1 again, constructions of the apparatus as a whole will be explained hereinafter.

FIG. 1 shows the state where the image forming unit 1BK for black is brought into the position close to the image forming position 50, and the state before it is positioned at the image forming position. Upon positioning from the above state as described earlier, the image forming unit 1BK is lowered downwardly to a slight extent so that the photosensitive drum contacts the transfer/transport belt 31 to be described later.

In the position above the group of the image forming units, there is provided a laser exposure device 3 which emits the laser beam scanning light 13 as modulated by the signal inputted to the printer section, and the laser beam 13 thus produced is reflected by mirrors 4 and 5 so as to be projected onto the photosensitive layer 9*a* of the photosensitive drum 9 of the image forming unit located at the image forming position for forming an electrostatic latent image on said photosensitive layer. The above function is effected on the image forming unit 1BK for black at the position lowered slightly downwardly as positioned from the state in FIG. 1. At a position for irradiating the photosensitive layer of the image forming unit after cleaning, located at the image forming position 50, there is provided an eraser lamp 8 fixed on the apparatus main body.

The transfer/transport belt 31 constituted by a polyester film in an endless belt configuration of 100 μm in thickness is directed around a driving roller 34 and a roller 35, and is adapted to be reciprocatingly movable in directions indicated by arrows W by attracting a paper sheet on its surface. It is to be noted here that in this embodiment, a distance between the driving roller 34 and the roller 35 is set to be slightly longer than a distance twice the length of an A4 size paper sheet in a direction of width thereof. At the right end of the transfer/transport belt 31 in a position above the roller 35, an adhering charger 37 is provided for attracting the paper sheet fed from the paper feeding section 36 onto the polyester film, and at the transfer section 33, a transfer charger 38 is disposed, while at the left end of the belt 31 in a position above the driving roller 34, a discharger 39 for discharging the paper sheet separated from the belt 31 and sent leftward and also, the transfer/transport belt 31 is provided as shown. As described earlier, at the transfer section 33, the transfer/transport belt 31 is raised by the belt restricting member 32 so as to be restricted in its upward and downward movements.

It should be noted here that in the present embodiment, although the transfer/transport belt 31 is composed of the polyester film, this may be modified to be prepare by a film made of a semi-conductive material prepared by dispersing carbon or the like in polyester, urethane, etc., and in such a case, it becomes easier to effect overlapping transfer, since the electrical charge during the charging is not readily accumulated in the transfer/transport belt 31.

In a position beside the transfer charger 38, a toner receptacle 40 is disposed to receive the waste toner sent out from the cleaner portion 27 when each of the image forming units 1BK to 1Y functions at the image forming position 50, while at the left end of the belt 31 below the driving roller 34, there is provided a belt cleaner portion 41 having a belt cleaner for cleaning the transfer/-transport belt. The toner receptacle 40 is connected to the belt cleaner portion 41 at a connecting portion 42, and the waste toner discharged from each image forming unit at the image forming position 50 is collected into the belt cleaner portion 41.

The transfer/transport belt 31, the transfer charger 38, and the belt cleaner portion 41, etc. are arranged to be displaceable to positions indicated by broken lines as a whole about the driving roller 34 for maintenance at paper jamming, etc.

Figure 6:
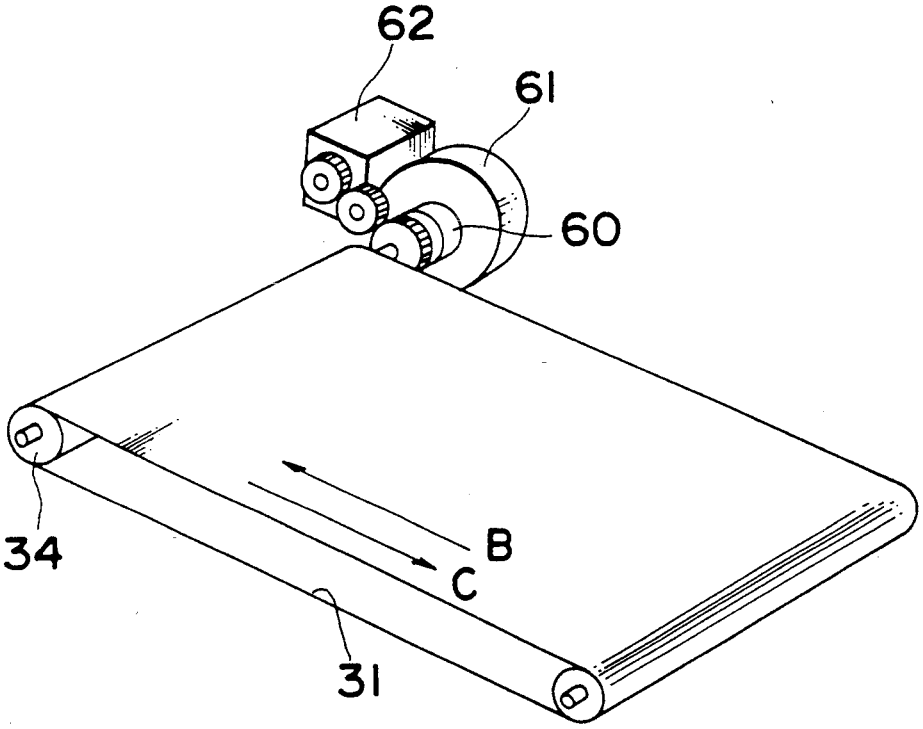

Referring particularly to FIG. 6, constructions and functions of the driving section for the transfer/transport belt 31 will be described hereinafter.

The driving roller 34 of the transfer/transport belt 31 is connected to a flywheel 61 through a magnet clutch 60, and also, to a belt driving motor 62 through a gear connected at one end of its shaft, another idle gear and a gear fixed to the shaft of the driving motor 62 which are in mesh with each other. The transfer/transport belt 31 effects the movement in a forward direction (indicated by the arrow B) during the image transfer, and the movement in the reverse direction (indicated by the arrow C) for returning the paper sheet, and by the action of the magnet clutch 60, the driving roller 34 is controlled to be connected to the flywheel 61 during the movement in the forward direction, and disengaged from the flywheel 61 in the case of the movement in the reverse direction.

Accordingly, during the image formation, the transfer/transport belt 31 can effect a displacing function small in the speed variation, and also, rapid change-over for the returning movement.

Described so far are the constructions and functions of the driving section for the transfer/transport belt 31.

Referring back to FIG. 1 again, at the left side of the apparatus housing adjacent to the belt 31 directed around the driving roller 34, a fixing device 44 is provided for fixing the toner image on the paper sheet after transfer, and the paper sheet thus fixed with the toner image is discharged through a pair of discharge rollers 45. Driving of the driving roller 34 for the transfer/-transport belt 31 and that of the fixing device 44 are respectively controlled by a transport control means (not shown).

In the foregoing, main constructions of the electrophotographic apparatus have been described.

Subsequently, functions of the above electrophotographic apparatus during formation of a color image in A4 size will be explained.

Figure 15:
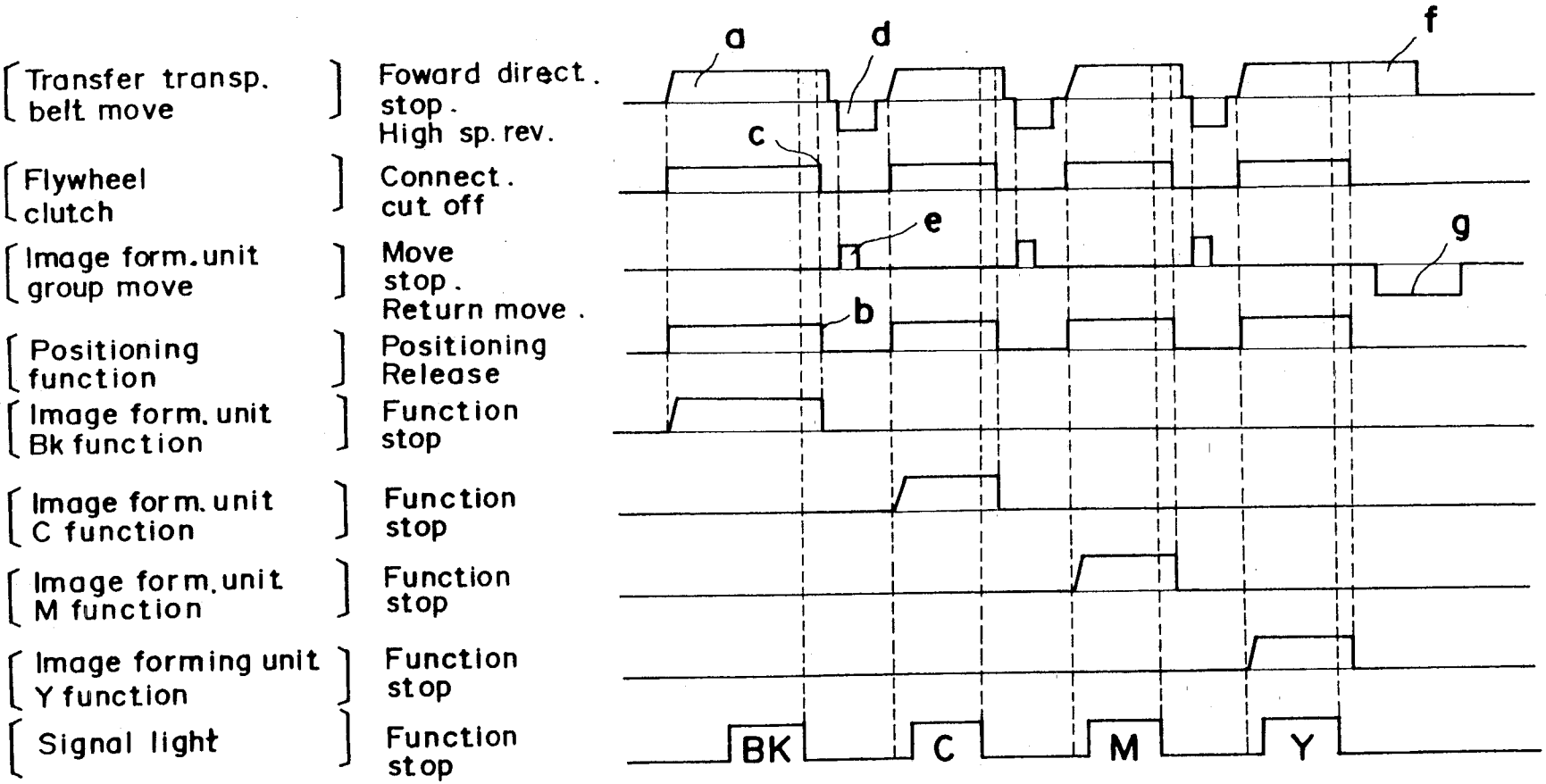
Figure 16:
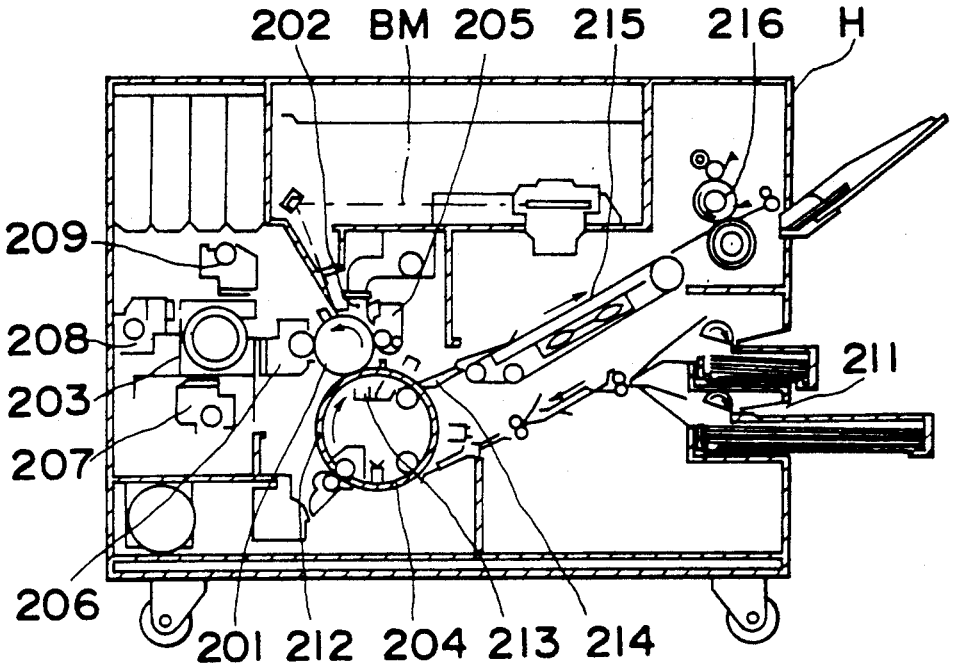
Fig. 16 PRIOR ART
Figure 17:
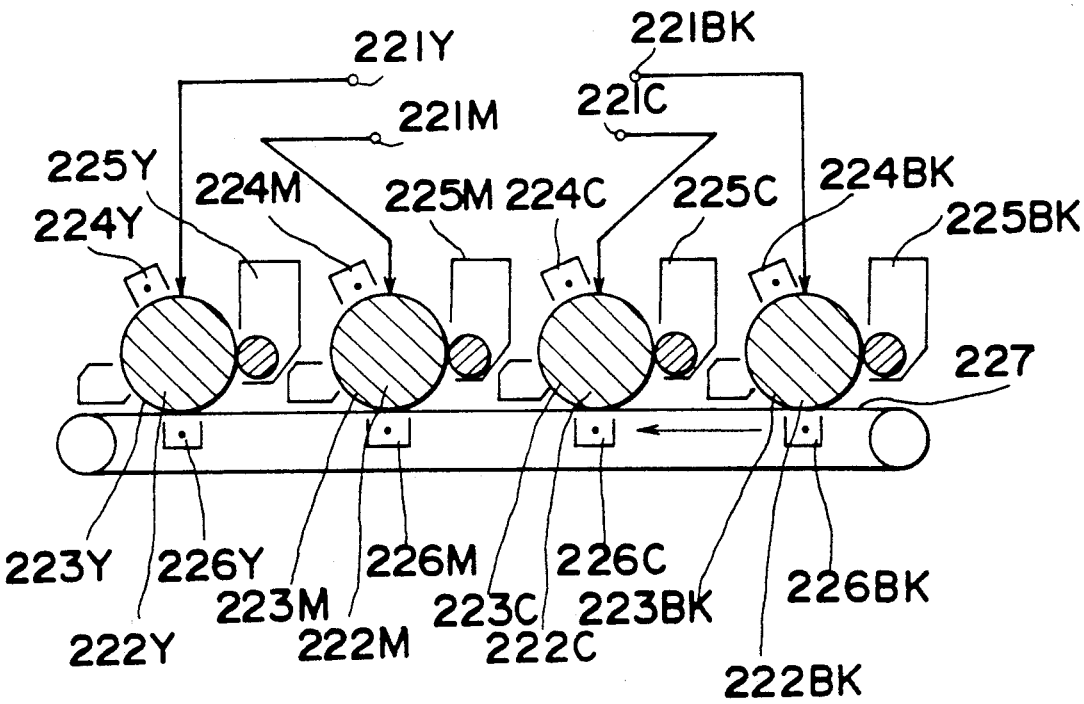
Fig. 17 PRIOR ART

FIG. 15 shows a timing chart for explaining functions at the respective portions of the apparatus.

An A4 size paper sheet (not shown) fed from the paper feeding section 36 in a direction of width is held on the transfer/transport belt 31 while being attracted onto said belt 31 by the action of the adhering charger 37, and is displaced in a leftward direction (referred to as a forward direction hereinafter) at a constant speed. A portion indicated by "a" in FIG. 15 shows the above function. At this time, since the paper sheet is positively attracted onto the belt 31, there is no slippage or deviation in positions between the transfer/transport belt 31 and the paper sheet even when the belt 31 is subjected to the reciprocating movement as described later, and thus, positioning may be readily effected when toner images of respective colors are overlapped.

In the first place, the image forming units 1BK to 1Y are in positions as shown in FIG. 1, and the image forming unit 1BK is located in the vicinity of the image forming position 50 as shown in FIG. 4. FIG. 1 shows the state before the image forming unit 1BK is positioned. Upon starting the function, the image forming unit 1BK for black is positioned at the image forming position 50 as described earlier with reference to FIGS. 4 and 5, and also confronting the transfer section 33. In timed relation with the paper sheet transported from the right side on the transfer/transport belt 31, a signal light for black is applied to the image forming unit 1BK by the laser exposure device 3, and thus, image formation by the black toner is effected. It is so set that in the above case, the speed for the image formation of the image forming unit 1BK (equal to the circumferential speed of the photosensitive drum) becomes equal to the moving speed of the transfer/transport belt 31, and together with the image formation, the black toner image is transferred onto the paper sheet by the action of the transfer charger 38 as the paper sheet is displaced. Immediately after the trailing edge of the paper sheet has passed through the transfer section 33 upon completion of transfer of all the black toner image, the image forming unit 1BK at the image forming position 50 is released from the positioning (indicated at "b" in FIG. 15), and the displacement of the belt 31 is once stopped. During such transfer function, since the driving roller 34 for the transfer/transport belt 31 is driven as it is connected with the flywheel 61, smooth rotation with less speed variation can be effected. Just before stopping upon completion of the transfer, the driving roller 34 for the belt 31 is disengaged from the flywheel 61 (indicated at "c" in FIG. 15).

Immediately after stopping, the belt 31 is displaced in the reverse direction at a speed sufficiently higher than the previous moving speed in the forward direction (the function as indicated at "d" in FIG. 15). In this case, since the driving roller 34 of the belt 31 is disengaged from the connection with the flywheel, quick stopping and reverse rotation at high speed may be effected. Since the transfer/transport belt 31 is displaced at high speed in the reverse direction, it is possible to return the paper sheet to the position before the transfer in a short period of time. It is to be noted that the leading edge of the paper upon stopping after completion of the transfer is located in the vicinity of the driving roller and does not come off from the belt 31 since said belt has a sufficient length.

Meanwhile, during displacement of the belt 31 in the reverse direction, the group of the image forming units 1BK, 1C, 1M and 1Y is driven by the displacing motor 30 as a whole and is moved leftward in FIG. 1 as one unit (the function indicated at "e" in FIG. 15) and the next image forming unit IC comes close to the image forming position 50. During the above time, since the image forming unit is located above the image forming position, there is no possibility that the black toner image on the moving paper sheet contacts the image forming unit for being disturbed.

After the trailing edge of the paper sheet has passed the transfer section 33 towards the right side and the image forming unit 1C has arrived at the image forming position 50, the image forming unit 1C is positioned in the similar manner as in the case of the unit 1BK, and the belt 31 ia again connected with the flywheel and displaced in the forward direction at a constant speed. In the similar manner as stated previously, the laser exposure device applies the signal light to the image forming unit 1C this time by the signal for cyan, and thus, formation and transfer of the toner image for cyan are effected. In this case, starting for displacement of the transfer/transport belt 31 and the starting of the signal light writing-in are so controlled in timing that subsequent toner image in cyan positionally coincides with the black toner image on the paper sheet.

The function similar to the above are effected also for magenta and yellow, and on the paper sheet, toner images of four colors as positionally aligned are overlapped to form the resultant color image. After the last yellow toner image has been transferred, the belt 31 continuous to move in the forward direction as it is ("f" in FIG. 15), and the paper sheet formed with the color image is separated from the transfer/transport belt 31 while being electrically discharged by the action of the discharger 39 so as to be subsequently fixed with the color toner image thereon by a fixing device 44, and is then fed out of the apparatus through the discharge rollers 45. Meanwhile, the image forming unit group is displaced in the opposite direction to the previous direction, and returned to the initial position ("g" in FIG. 15) to prepare for the next image formation.

It is to be noted here that since a distance between the driving roller 34 and the roller 35 for the belt 31 is set to be slightly longer than a length for 7/4 of a total length in a lateral direction of the image forming unit group in FIG. 1, even when said image forming unit group is displaced as one unit so that each of the image forming units reaches the image forming position, such image forming unit does not contact the adhering charger 37 and the discharger 39, and that owing to the fact that the paper sheet is sufficiently discharged when it is separated from the belt 31, there is no scattering of toner on the paper sheet, and thus, beautiful color images may be advantageously obtained.

Moreover, during image formation, the belt 31 is driven as it is coupled with the flywheel 61, speed variation can be reduced to provide favorable color images with less jitter, etc.

Furthermore, with respect to alignment in colors, since the image forming position 50 is set at one position, with the exposure position and the transfer position being fixed, the image quality is affected only by the position of the image forming unit for each color to be brought to said image forming position. In this case, however, only the position of the photosensitive drum of the image forming unit is important, and the position and orientation of other parts are not related to the positional deviation.

According to the present invention, since the rotational center of the photosensitive drum of the image forming unit during the image formation is accurately positioned at the image forming position for favorable reproduction by the positioning member 57 irrespective of the stopping position of the support member, positions of the respective color images are correctly aligned, thus providing beautiful color images with less color misalignment. The stopping position and displaced position of the support member are not related to the positioning, and setting can be made with a large tolerance.

On the other hand, the photosensitive drum 9 during functioning at the image forming position is cleaned on its photosensitive surface 9*a* after transfer by the cleaner 27 (FIG. 2), and the toner discharged at that time is collected into the belt cleaner portion 41 through the toner receptacle 40 and the connecting portion 42. Similarly, the toner scattered on the transfer/transport belt 31 is also cleaned by the belt cleaner portion 41 during functioning.

So far, the electrophotographic apparatus of the present embodiment has been described with reference to the functioning during A4 color mode.

Subsequently, the functioning of the above electrophotographic apparatus during single color mode will be described.

In the single color mode, in the first place, before the paper sheet reaches the transfer position, the image forming unit of the predetermined color is displaced to and positioned at the image forming position. Then, in the similar manner as before, the image formation and transfer of the predetermined color are effected, and this time, the belt 31 is continuously displaced in the forward direction as it is even after the transfer for fixing and discharge of the paper sheet. Accordingly, during the single mode, a paper sheet larger than A4 size, for example, paper sheet of A3 size may be used. Meanwhile, waste toner discharged from the cleaner 27 at this time is collected in the belt cleaner portion 41 through the connecting portion 42 at any time.

Subsequently, the construction for the exchange of the image forming units in the above electrophotographic apparatus will be explained with reference to FIG. 3.

FIG. 3 shows the state where one image forming unit 1Y of the image forming unit group has been drawn out of the apparatus. The first support member 47 supporting the group of the image forming units 1BK to 1Y is arranged to be displaceable in the direction of depth of the apparatus with respect to the second support member 48 which supports said first support member 47. Moreover, the second support member 48 is displaceably supported in a lateral width direction of the apparatus along rail members 49 fixed to the main body, while it is also arranged to be reciprocatingly displaceable by being connected with part of a belt 29 driven by the displacing motor 29. During exchange of the image forming units, the image forming unit group as a whole is first drawn out as one unit together with the first supporting member 47 towards the front side of the apparatus as shown in FIG. 3, and then, each of the respective image forming units may be independently pulled out upwardly.

In the foregoing, the constructions and functions of the electrophotographic apparatus according to the first embodiment of the present invention have been explained.

According to the first embodiment of the present invention, by the construction as described so far, since all the image formation for the respective colors may be effected at the same image forming position without employing the transfer drum of a complicated construction, the positioning of the respective colors may be effected by the simple construction, while accurate positioning is possible by the action of the positioning means, and thus, formation of beautiful color images without color deviation can be achieved.

Moreover, since the transfer/transport means can effect transport of the paper sheet with a small speed variation, favorable color images may be obtained with less jitter, etc.

Furthermore, owing to the construction that the image forming means is independent in each color so as to be completed as one image forming means, the construction is simplified, and is superior in the aspect of maintenance for example, in that the image forming means may be exchanged for each color.

Additionally, by making it possible to draw the image forming unit group ont of the apparatus as one unit, and to exchange the respective image forming units independently, the exchange of the image forming units and maintenance thereof is simplified for facilitation of handling.

Thus, according to construction of the above embodiment, since each image forming unit including the photosensitive member may be adjusted outside singly, for example, the unit already adjusted at the delivery from a factory may be simply exchanged at the site.

Further, during the single mode function, since the image formation may be continuously effected by displacing the transfer/transport belt only in the forward direction, the image formation in the single color may be rapidly effected even on a long paper sheet larger than A4 size.

Another advantage of the construction for the foregoing embodiment is such that in the case where color images are to be continuously formed, since each of the photosensitive drums is at rest for each time during formation of other color, stable images without electrostatic fatigue can be provided.

It should be noted here that in the foregoing embodiment, although the image forming units of specific construction have been employed, the concept of the present invention is not limited in its application to such image forming units of the particular construction alone, but may be applied to image forming units having construction based on a conventional developing method.

Specific embodiment 2

Figure 8:
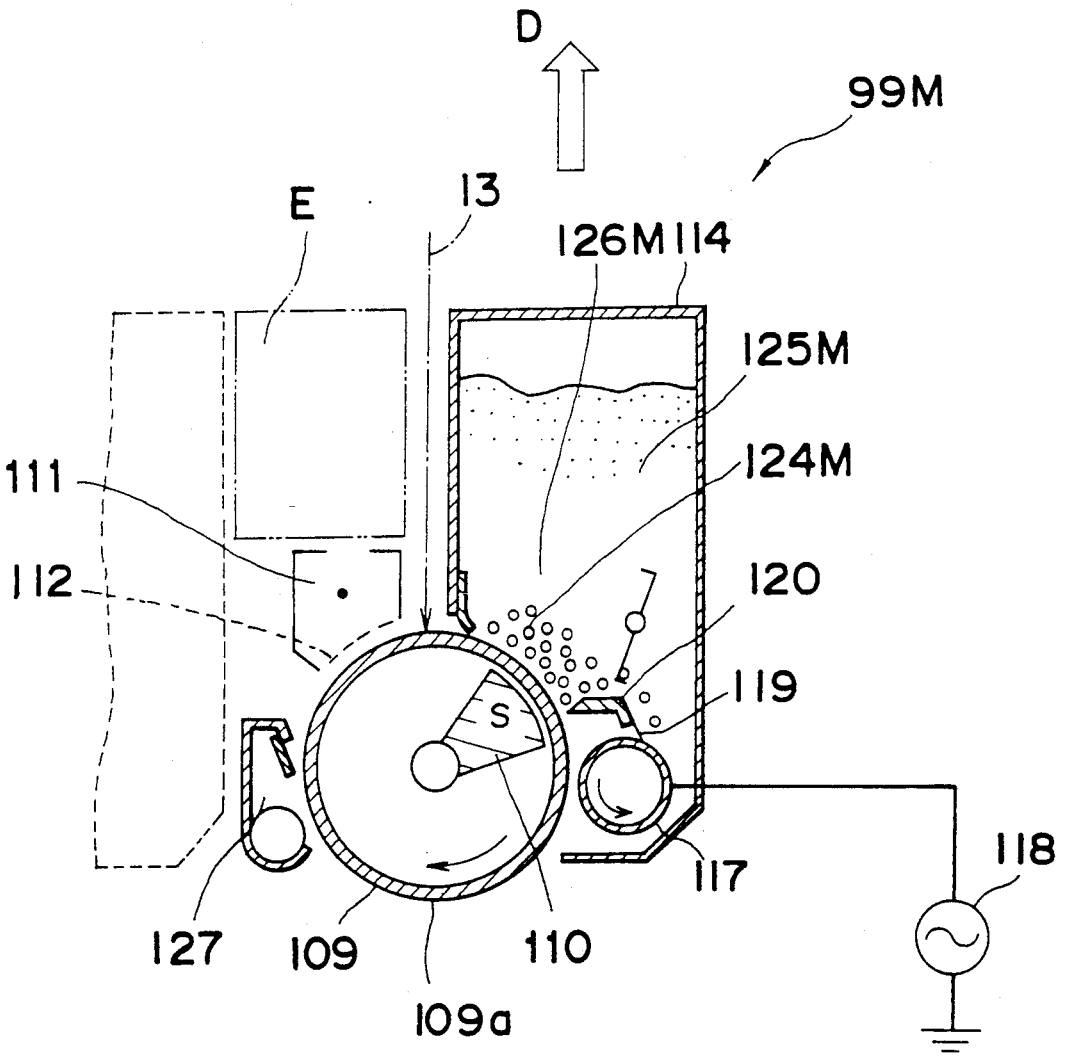
Figure 9:
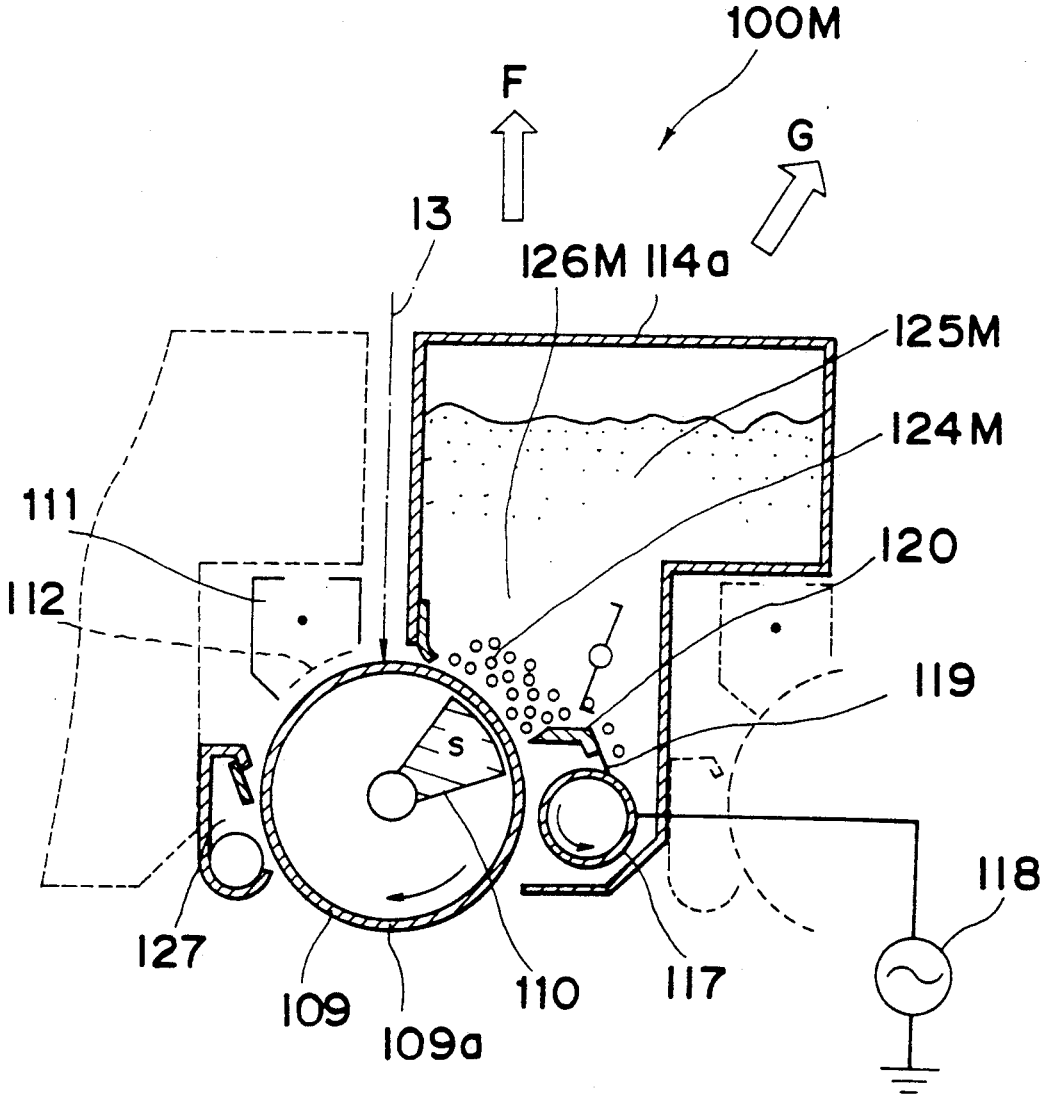
Figure 10:
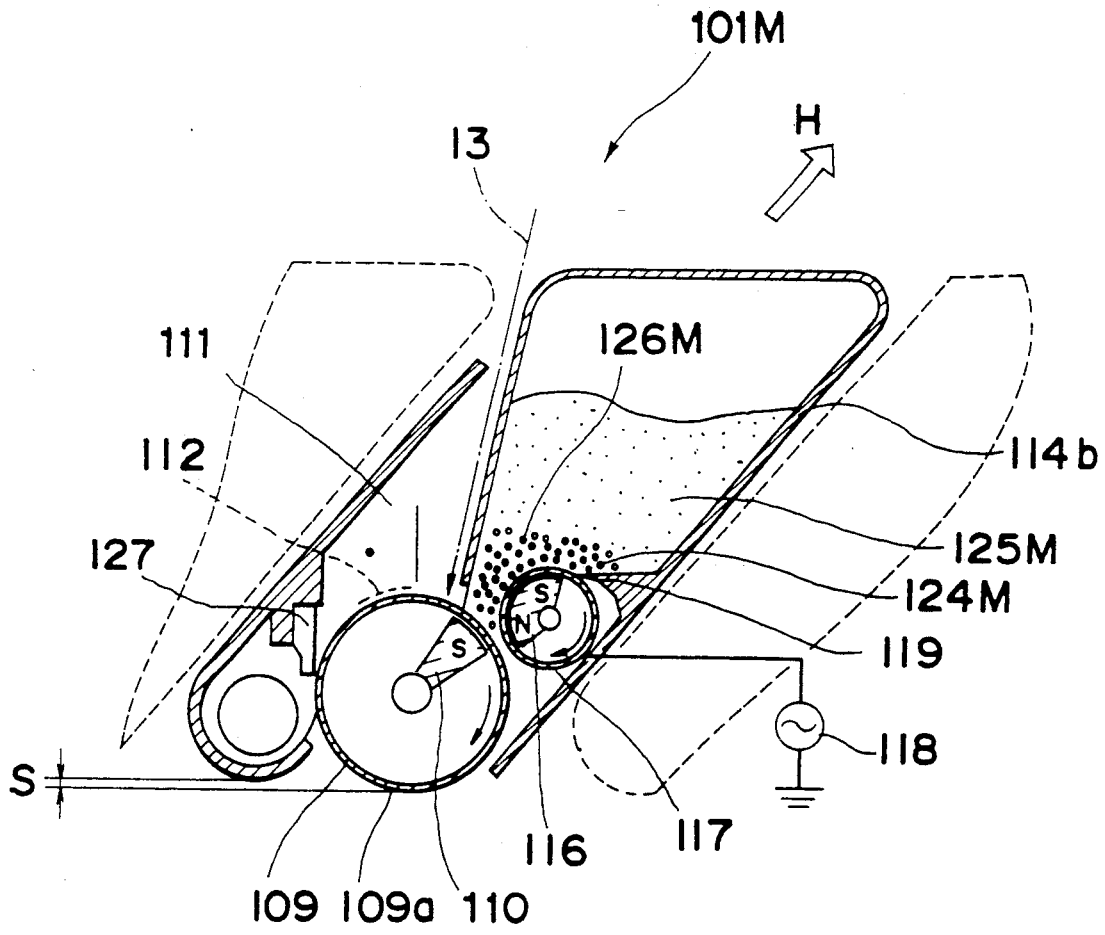

Referring to FIGS. 8 to 10, there are shown first to third examples for constructions of the image forming unit for magenta which may be employed in the present invention. In each of FIGS. 8 to 10, the position of the neighboring image forming unit is shown by broken lines. Since the respective image forming units are constituted by the same members except for the developing materials accommodated therein, description will be given only with respect to the image forming unit 99M for magenta and explanation for other image forming units is omitted, with like parts being designated by like reference numerals, and in the case where it is necessary to distinguish the construction of the unit for each color, symbols representing respective colors will be affixed to numerals.

FIG. 8 shows the construction of the image forming unit 99M for magenta according to a first example.

The image forming unit 99M includes a developing material hopper 114 containing a two-component developing material 126M, a photosensitive drum 109 having an organic photosensitive layer 109*a* on its outer peripheral surface and rotatably provided at the lower portion of the hopper 114, and a magnet 110 unrotatably fixed to the same shaft for the photosensitive drum 109. Around the photosensitive layer 109*a*, there are sequentially disposed various processing devices such as a corona charger 111 for negatively charging the photosensitive layer 109*a* through a grid electrode 112 for controlling charge potential of the photosensitive layer 109*a* to be subjected to the laser beam scanning light 13, a toner restricting blade 120 of magnetic stainless material disposed close to the photosensitive layer 109*a*, a collecting electrode roller 117 of aluminum rotatably provided adjacent to the photosensitive drum 109 and connected to an A.C. high voltage source 118 so as to be applied with a voltage thereby, a scraper 119 of a polyester film provided to scrape off toner on the surface of the roller 117, and a cleaner 127 for cleaning off toner remaining on the photosensitive layer 109*a* after transfer.

The organic photosensitive material layer 109*a* is prepare by dispersing phthalocyanine into polycarbonate group binder resin. The two-component developing material 126M is produced by mixing ferrite carrier 124M with particle diameter of 100μm coated on the surface by silicone resin and toner 125M for attraction onto the surface of the photosensitive layer 109*a* by a magnetic force of the magnet 110, while the toner 125M is prepared by dispersing a pigment in a polyester resin, with further addition of an additive thereto.

Magnetic flux density on the surfaces of the photosensitive layer 109*a* is 800 gauss at the maximum position. The photosensitive drum 109 has a diameter of 30 mm and was rotated in a direction indicated by an arrow at a circumferential speed of 120 mm/sec. Although the image forming unit of this type has an advantage in that when four units thereof are disposed side by side, it is possible to withdraw each unit in a direction indicated by an arrow D as shown in FIG. 8, there is such a drawback that an upper space E indicated by two broken lines above the corona charger 111 and the cleaner 127 can not be effectively utilized.

FIG. 9 shows the construction of the image forming unit 100M according to a second example, in which like parts in the first example of FIG. 8 are designated by like reference numerals for brevity of explanation.

In the image forming unit 100M of FIG. 9, the developing material hopper 114 in the image forming unit 99M in FIG. 8 has been replaced by a developing material hopper 114*a* arranged to effectively utilize the space by taking into account the shape of the neighboring image forming unit. In the image forming unit 100M, the capacity thereof can be increased to about 1.5 times that of the image forming unit 99M in FIG. 8. However, when the image forming unit is to be replaced singly, it can not be drawn out in a direction of an arrow F or an arrow G in FIG. 9 due to contact with the neighboring image forming units. By way of example, in the case where the image forming unit disposed at the rightmost side of the four image forming units aligned side by side is to be drawn out upwardly, it is first required to draw out all of the neighboring units disposed at the left side thereof. Accordingly, in this case, there is such a restriction in designing that it is necessary to arrange to withdraw the image forming units towards the front side in the drawing.

FIG. 10 shows the construction of the image forming unit 101M according to a third example, in which the problem in the image forming unit 100M in FIG. 9 has bee eliminated. In the construction of FIG. 10 also, like parts in FIG. 8 are designated by like reference numerals for brevity of explanation.

In the image forming unit 101M of FIG. 10, the developing material hopper 114 in the image forming unit 99M in FIG. 8 has been replaced by a developing material hopper 114*b* arranged to effectively utilize the upper space above the corona charger 111 and cleaner 127, and also to take into account, facilitation in drawing out the image forming unit singly. By this image forming unit 101M, the capacity of the developing material hopper 114*b* can be increased, and even when four image forming units of this type are arranged side by side, it is possible to independently take out the image forming unit in a direction indicated by an arrow H in FIG. 10.

The image forming unit 101M includes the developing material hopper 114*b* containing a two-component developing material 126M, a photosensitive drum 109 having an organic photosensitive layer 109*a* on its outer peripheral surface and rotatably provided at the lower portion of the hopper 114*b*, and a magnet 110 unrotatably fixed to the same shaft for the photosensitive drum 109. Around the photosensitive layer 109*a*, there are sequentially disposed various processing devices such a corona charger 111 for negatively charging the photosensitive layer 109*a* through a grid electrode 112 for controlling charge potential of the photosensitive layer 109*a* to be subjected to a laser beam scanning light 13, a collecting electrode roller 117 of aluminum rotatably provided adjacent to the photosensitive drum 109 and connected to an A.C. high voltage source 118 so as to be applied with a voltage thereby, an unrotatable magnet 116 coaxially fixed within said collecting electrode roller 117, a scraper 119 of a polyester film provided to scrape off toner on the surface of the roller 117, and a cleaner 127 for cleaning toner remaining on the photosensitive layer 9*a* after transfer.

The organic photosensitive layer 109*a* is prepared by dispersing phthalocyanine into polycarbonate group binder resin. The two-component developing material 126M is produced by mixing ferrite carrier 124M with particle diameter of 100 μm coated on the surface by silicone resin and toner 125M for attraction onto the surface of the photosensitive layer 109*a* by a magnetic force, while the toner 125M is prepared by dispersing a pigment in a polyester resin, with further addition of an additive thereto.

Subsequently, the color electrophotographic apparatus according to a second embodiment of the present invention will be described with reference to the drawings.

Figure 7:
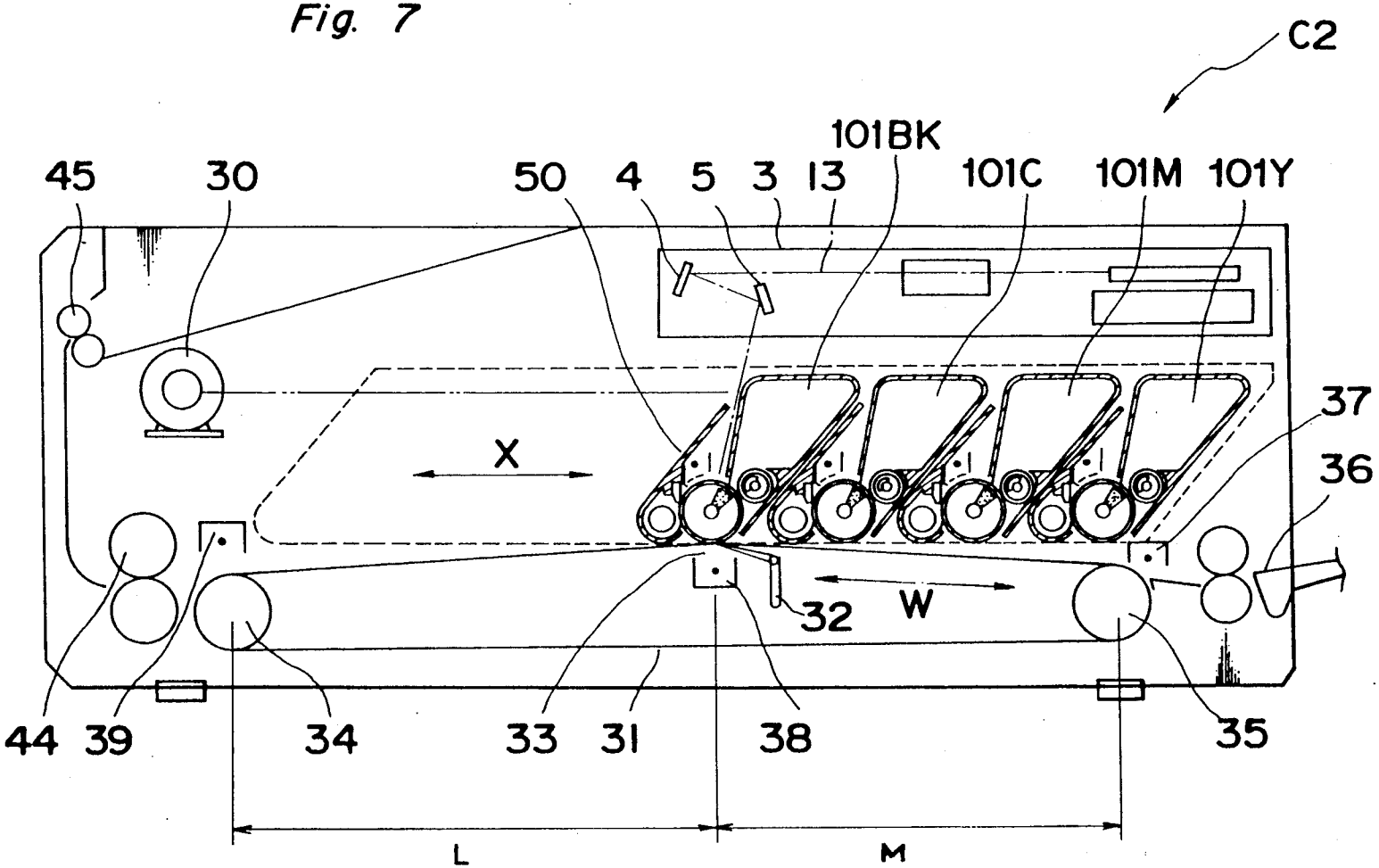

In FIG. 7, there is shown a color electrophotographic apparatus C2 according to the second embodiment of the present invention mainly with respect to a printer section thereof for the image formation.

Since the main difference of the electrophotographic apparatus C2 according to the second embodiment of the present invention from that of the first embodiment of FIG. 1 resides in the image forming units employed therein, other parts having similar functions as those in FIG. 1 are designated by like reference numerals in FIG. 7 for brevity of explanation.

In the first place, at the printer section, image forming units 101BK, 101C, 101M, and 101Y as four sets of image forming means for black, cyan, magenta and yellow are disposed side by side. Here, for the image forming units are constituted by the same members except for the developing materials accommodated therein, description will be given only with respect to the image forming unit 101M for magenta and explanation for other image forming units is omitted, with like parts being designated by like reference numerals, and in the case where it is necessary to distinguish the construction of the unit for each color, symbols representing respective color will be affixed to numerals.

Referring also to FIG. 10, the functioning of the respective image forming units will be described hereinbelow. The photosensitive layer 109*a* of the photosensitive drum 109 charged to −500 V by the corona charger 111, with an applied voltage at −5 kV, and a voltage for the grid 12 at −500 V). The laser beam scanning light 13 was projected onto the photosensitive layer 109*a* thus charged, thereby to form an electrostatic latent image thereon. At this time, the exposure potential for the photosensitive layer 109*a* was −100 V. When the photosensitive layer 109*a* thus formed with the latent image was passed through the developing material 126M, the developing material 126M was attracted by the magnet 110 within the photosensitive drum 109, and thereafter, the carrier 124M in the developing material 126M was collected on the collecting electrode roller 117 by the magnetic force of the magnet 116 within said roller 117.

An A.C. voltage (frequency 1 kHz) of 400 Vo-p (peak to peak 800 V) superposed with a D.C. voltage of −300 V was applied to the electrode roller 117 by the A.C. high voltage source 118, whereby the developing material 126M is moved between the photosensitive layer 109*a* and the collecting electrode roller 117 while in motion by receiving the magnetic force simultaneously with the electrostatic force, and the toner image subjected to negative-positive inversion only at the image portion was left on the photosensitive layer 109*a*. The developing material adhering to the electrode roller 117 was scraped off by the scraper 119 and returned into the developing material hopper 114*b* again for use in the subsequent image formation.

In the manner as described so far, the toner image in the magenta color is obtained on the photosensitive surface 109*a*.

Each of the image forming units 101BK, 101C, and 101Y other than the unit 101M also has a similar construction and functions in the similar manner.

Referring back to FIG. 7, the construction of the printer section will be described hereinbelow.

The image forming units as a whole can be displaced in the horizontal direction (in a direction indicated by an arrow X) as driven by the displacing motor 30 for the displacing means, and the respective image forming units may be successively positioned at the image forming position 50 confronting the transfer section 33 where the belt 31 is slightly pushed up by the belt restricting member 32. Since the construction for the displacement of the image forming units is similar to that as described earlier with reference to the first embodiment of FIG. 1, detailed description thereof is abbreviated here for brevity. During image formation stand by period, the black unit 101BK of the image forming units 101BK, 101C, 101M and 101Y disposed side by side is disposed in the vicinity of the image forming position 50 as shown in FIG. 7.

Subsequently, referring to FIGS. 11 and 12, the constructions and functions of the image forming units according to the present embodiment will be described.

Since the fundamental constructions of the first support member and the second support member, etc. are generally similar to those in the first embodiment described earlier, detailed description thereof is abbreviated here for brevity of explanation. Although the arrangement for positioning the image forming unit located in the vicinity of the image forming position, at said image forming position is also generally similar to that in the first embodiment, the amount for the image forming unit to move for the positioning is reduced by a large extent according to the present embodiment by displacing upwardly and downwardly, the member equivalent to the positioning member 57 in the first embodiment during the positioning and releasing.

Figure 11:
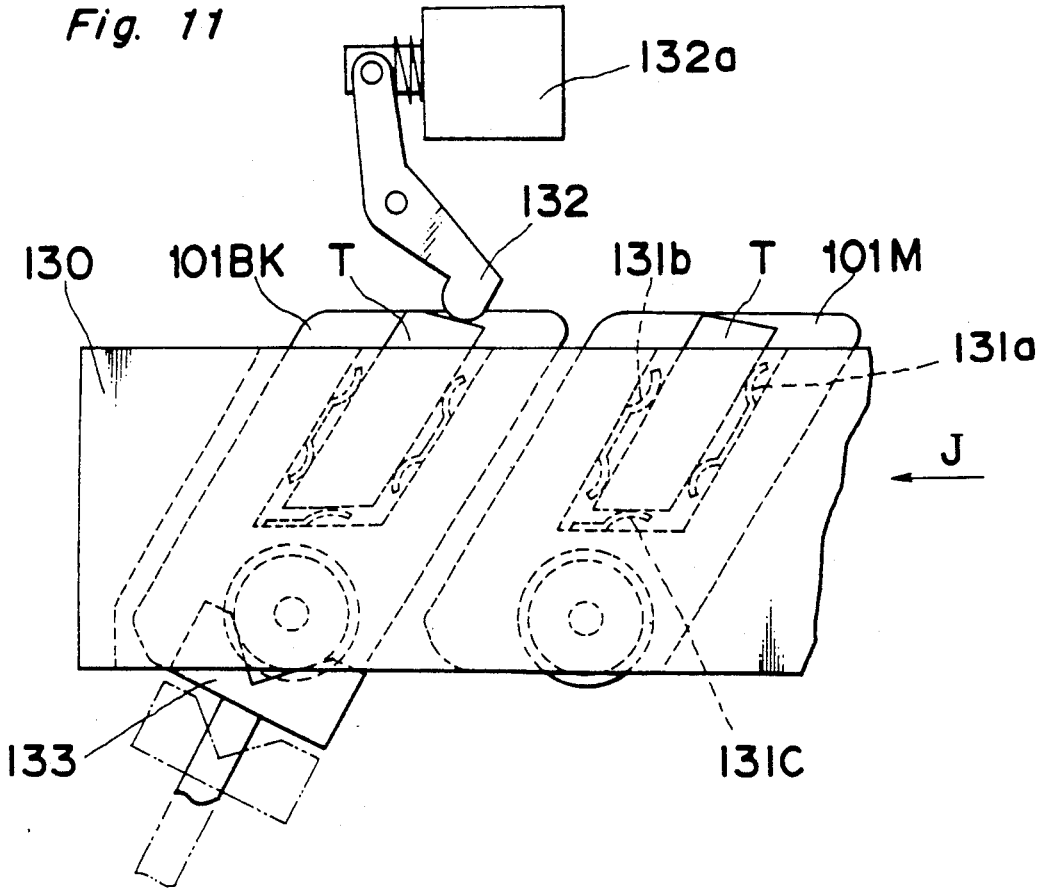
Figure 12:
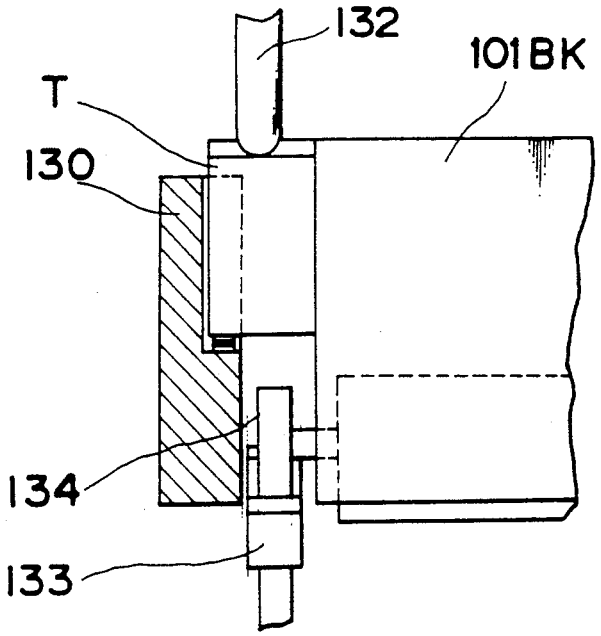

FIGS. 11 and 12 show the state where the black image forming units 101BK is positioned at the image forming position.

The image forming unit in the state where it is not positioned is shown by the magenta image forming unit 101M in FIG. 11, in which a protrusion T provided at the side face of each image forming unit is supported by the first support member 130 through plate springs 131*a*, 131*b* and 131*c* provided in a groove formed in the inner face of said first support member 130. Accordingly, the image forming unit to positioned is adapted to be movable to a slight extent with respect to the first support member 130 by the amount for the plate springs to deflect.

Meanwhile, as shown by the black image forming unit 101BK in FIG. 11, the positioning with respect to the image forming position is effected in such a manner that simultaneously with depression of the protrusion T of the image forming unit by a depressing lever 132 actuated by a solenoid 132*a*, a positioning member 133 having a V-shaped groove is displaced upwards from a position before the positioning as indicated by a two-dotted chain line, to the position of a solid line or engagement with a bearing 134 for the photosensitive drum. The above state as observed in a direction indicated by an arrow J is shown in a fragmentary side elevational view partly in section in FIG. 12. The amount of displacement of the image forming unit during the above positioning may be so small that a positional error of the first support member can be absorbed thereby.

By the above construction, there can be effected accurate positioning of the image forming unit which is determined only by the positional accuracy of the positioning member 133 irrespective of some positional errors in the vertical direction set position or stopping position of the first support member 130 with respect to the image forming position.

Since the positioning member 133 is returned to the position indicated by the two-dotted chain line upon completion of the image formation by one image forming unit, there is no possibility that, during the displacement of the image forming unit, it is interfered by the positioning member.

Described so far are the constructions and functions for the positioning arrangement of the image forming unit.

The arrangement for supporting the image forming unit is the same as that described earlier with reference to FIG. 3 for the first embodiment, and so arranged that the respective units are taken out upwardly in the state where the first support member has been drawn out of the apparatus. In the above case, according to the present invention, owing to the fact that each of the image forming units has a cross section generally in a parallelogram shape as shown in FIG. 10, it can be readily withdraw from the first support member if pulled up in a direction of the arrow H as shown in FIG. 10.

Since the constructions and functions of the other exposure device portion, transfer belt portion, etc. are generally similar to those in the first embodiment, detailed description has been abbreviated here for brevity of explanation.

It is to be noted here that, in the present embodiment, in the case where it is necessary to remove a paper sheet jammed within the apparatus, the four image forming units are displaced towards the right side end (as shown in FIG. 7) for the paper jamming at a portion L in FIG. 7, and towards the left side end for the paper jamming at a portion M for the removal of the paper sheet.

Described in the foregoing are the explanation of the main constructions of the electrophotographic apparatus C2 of the present embodiment.

Subsequently, functions of the above electrophotographic apparatus during formation of a color image in A4 size will be explained.

An A4 size paper sheet (not shown) fed from the paper feeding section 36 in a direction of width is held on the transfer/transport belt 31 while being attracted onto said belt 31 by the action of the adhering charger 37, and is displaced in a leftward direction (referred to as a forward direction hereinafter) at the same speed as that of the image formation in the image forming unit.

In the stand-by state of the apparatus, the respective image forming units 101BK to 101Y are in positions as shown in FIG. 7, and the image forming unit 101BK is located in the vicinity of the image forming position 60 and confronts the transfer section 33. Upon starting of the functioning of the apparatus, the image forming unit 101BK for black is positioned at the image forming position 50 as described earlier, and in timed relation with the paper sheet transported from the right side on the transfer/transport belt 31, a signal light for black is applied to the image forming unit 101BK by the laser exposure device 3, and thus, image formation by the black toner is effected. It is so set that in the above case, the speed for the image formation of the image forming unit 101BK (equal to the circumferential speed of the photosensitive drum) becomes equal to the moving speed of the transfer/transport belt 31, and together with the image formation, the black toner image is transferred onto the paper sheet by the action of the transfer charger 38 as the paper sheet is displaced. Immediately after the trailing edge of the paper sheet has passed through the transfer section 33 upon completion of transfer of all the black toner image, the belt 31 is once stopped in its displacement, and then, displaced in a direction opposite to the previous direction (referred to as a reverse direction) at a speed larger that that in the previous displacing speed in the forward direction. At this time, the leading edge of the paper sheet is stopped before the driving roller 34 since the belt 31 is sufficiently long, and is not separated from said belt 31.

Meanwhile, at approximately the same time as the starting of displacement of the belt 31 in the reverse direction, the image forming unit 101BK is released from the positioning, and the group of the image forming units 101BK, 101C, 101M and 101Y is driven by the displacing motor 30 as a whole and is moved leftward in FIG. 7 as one unit. In this case, the displacing speed in the reverse direction of the belt 31 and the displacing time of the image forming units are so set that, immediately after the trailing edge of the paper sheet moving in the reverse direction has passed the transfer section 33, the image forming unit 101C arrives in the vicinity of the image forming position 50. During the movement of the paper sheet in the reverse direction, since the portions of the image forming unit other than the photosensitive drum confront the transfer section 33, and as shown at S in FIG. 10, the lowermost faces of such portions are set to be rather higher than the lowermost layer of the photosensitive drum so as not to contact the transfer/transport belt 31, there is no possibility that the toner image on the paper sheet contacts the image forming unit during displacement in the reverse direction so as to be undesirably disturbed.

After the trailing edge of the paper sheet has passed the transfer section 33 towards the right side and the image forming unit 101C has arrived in the vicinity of the image forming position 50 so as to be positioned, the belt 31 is again displaced in the forward direction at a constant speed. In the similar manner as stated previously, the laser exposure device 3 applies the cyan signal to the image forming unit 101C this time, and thus, formation and transfer of the toner image for cyan are effected. In this case, starting for displacement of the transfer/transport belt 31 is so controlled in timing that, with respect to the starting of the signal light writing-in, subsequent toner image in cyan positionally coincides with the black toner image on the paper sheet.

The functions similar to the above are effected also for magenta and yellow, and on the paper sheet, toner images of four colors as positionally aligned are overlapped to form the resultant color image. After the last yellow toner image has been transferred, the belt 31 continuous to move in the forward direction as it is, and the paper sheet formed with the color image is separated from the transfer/transport belt 31 while being electrically discharged by the action of the discharger 39 so as to be subsequently fixed with the color toner image thereon, and is then fed out of the apparatus through the discharge roller 45. Upon completion of the color image formation, the image forming unit is returned to the position before starting of the function to assume the stand-by state.

Described so far is the functioning of the electrophotographic apparatus of the present embodiment in the A4 size color mode.

In the functioning for the single color mode, particularly during printing of black most frequently used 101BK is positioned from the state of FIG. 7 generally similar to the stand-by state of the apparatus.

In the foregoing, the constructions and functions of the electrophotographic apparatus C2 according to the second embodiment of the present invention have been explained.

According to the present embodiment, since the black image forming unit is disposed at the leftmost end of the row of four image forming units, the color units other than the black unit are disposed at positions spaced from the fixing device which is a heat source, and therefore, even when printing in many sheets continue for a long period of time, occurrence of a trouble such as aggregation of toner, etc. due to influence of heat on the other color units may be advantageously prevented.

In the general applications, only the black toner tends to be used most frequently in the printing of documents, etc, and therefore, in this case, if the black image forming unit is disposed in the vicinity of the image forming portion during the stand-by period for the image formation, not only the color units other than the black unit are protected against troubles by heat as described above, but time required up to the printing function starting may be advantageously reduced, whereby when the color electrophotographic apparatus is used for printing in black alone, performance not inferior to the general white and black electrophotographic apparatus can be achieved.

Furthermore, when the space above the corona charger which normally becomes a wasteful space not utilized at all is utilized as the space for collecting the developing material of the neighboring image forming unit, such space is effectively utilized to the maximum degree without changing the size of the group of the image forming units as a whole, when the four image forming units are disposed side by side. In this case, if each of the image forming units is formed to have a side face configuration which allows withdrawal thereof slantwise upwardly, for example, generally a parallelogram shape, one image forming unit may be singly drawn out from the row of the four image forming units, and this provides a superior effect in the aspect of maintenance when the image forming unit is to be exchanged for each color.

Specific embodiment 3

Hereinafter, a third embodiment according to the present invention will be described with reference to FIGS. 13 and 14. The third embodiment to be described hereinbelow is different from the second embodiment in the construction of the image forming unit.

Figure 14:
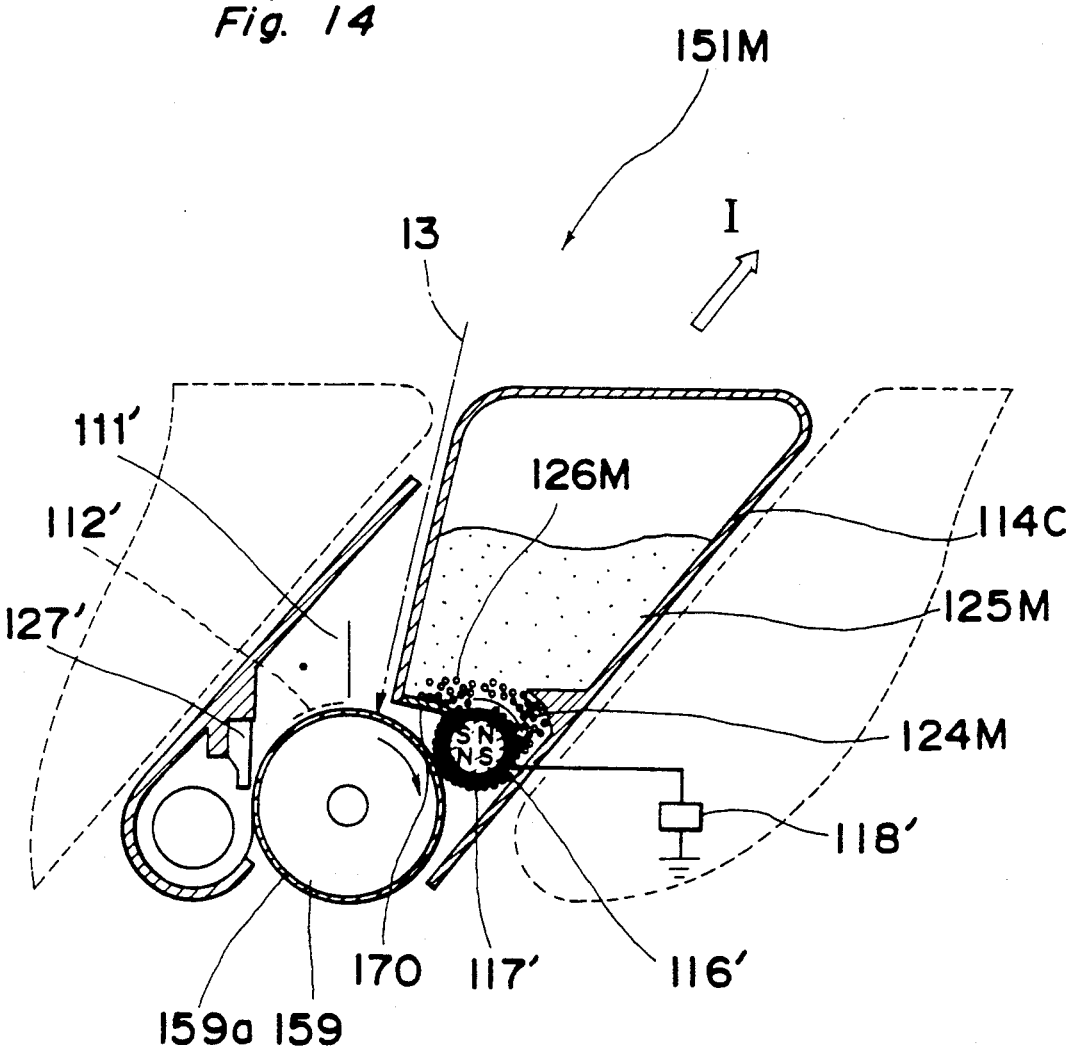

FIG. 14 shows the image forming unit 151M for magenta employed in the third embodiment of the present invention. This unit 151M adopts the magnetic brush developing method generally employed for the developing apparatus in the conventional electrophotographic apparatus.

In the construction of FIG. 14, like parts in FIG. 10 are designated by like reference numerals for brevity of explanation.

In the image forming unit 151M of FIG. 14, there is provided a developing material hopper 114C arranged to effectively utilize the upper space above the corona charger 111' and cleaner 127', and also to take into account, facilitation in drawing out the image forming unit singly. By this image forming unit 151M, the capacity of the developing material hopper 114C can be increased, and even when four image forming units 151BK, 151M, 151C and 151Y of this type are arranged side by side (FIG. 13), it is possible to independently take out the image forming unit in a direction indicated by an arrow I in FIG. 14.

Subsequently, the construction of the above image forming unit as represented by the unit 151M for magenta will be described.

The image forming unit 151M includes the developing material hopper 114C containing a two-component developing material 126M, and a photosensitive drum 159 having a photosensitive layer **159*a* on it outer peripheral surface and rotatably provided at the lower portion of the hopper 114C. Around the photosensitive layer 159*a*, there are sequentially disposed various processing devices such as a corona charger 111' for uniformly charging the photosensitive layer 159*a* through a grid electrode 112' for controlling charge potential of the photosensitive layer 195*a* to be subjected to the laser beam scanning light 13, a developing roller 117, rotatably provided adjacent to the photosensitive drum 159, and connected to an A.C. high voltage source 118' so as to be applied with a voltage thereby, magnet members 116' coaxially fixed within said developing roller 117', a developing material layer thickness restricting member 170 to form a developing material layer, on the surface of the roller 117, and a cleaner 127' for cleaning the photosensitive layer surface 159*a***.

In the developing material hopper 114C, the two-component developing material 126M produced by mixing ferrite carrier 124M with particle diameter of 100 μm coated on the surface by silicone resin and toner 125M is accommodated so as to be attracted onto the developing roller 117, having the magnet members 116' therein, thereby to form a developing material layer by the developing material layer thickness restricting member 170, and while the roller 117, is being rotated in the direction of an arrow, the electrostatic latent image on the photosensitive layer **195*a*** is developed.

Subsequently, a color electrophotographic apparatus according to a third embodiment of the present invention will be described with reference to the drawings.

Figure 13:
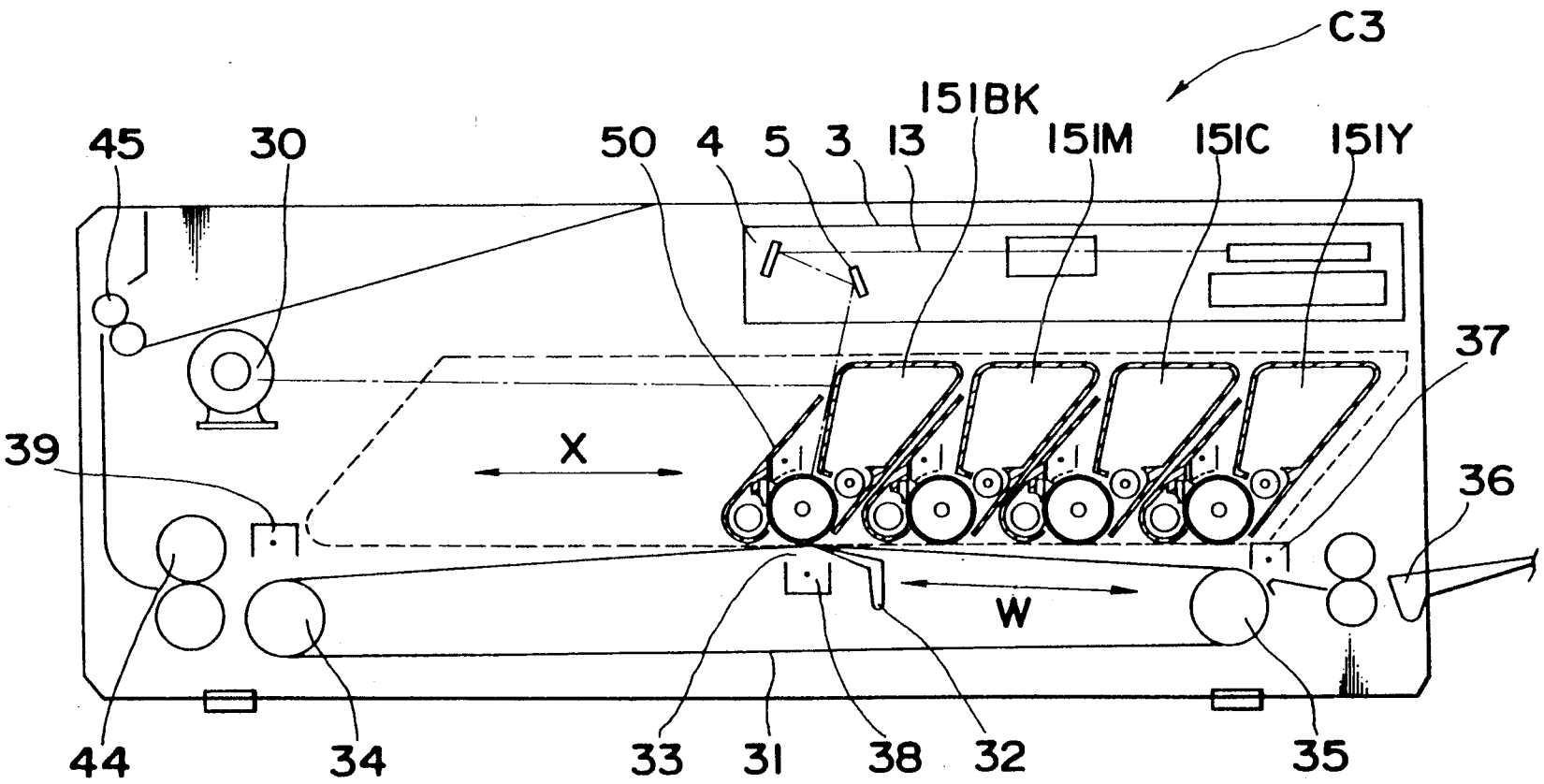

In FIG. 13, there is shown the color electrophotographic apparatus C3 according to the third embodiment of the present invention mainly with respect to a printer section thereof for the image formation.

Since the main difference of the electrophotographic apparatus C3 according to the third embodiment of the present invention from that of the first embodiment of the FIG. 1 resides in the image forming units employed therein, other parts having similar functions as those in FIG. 1 are designated by like reference numerals in FIG. 13 for brevity of explanation.

In the first place, at the printer section, image forming units 151BK, 151C, 151M, and 151Y as four sets of image forming means for black, cyan, magenta and yellow are disposed side by side.

Subsequently, the functioning of the above printer section will be described with reference also to FIG. 14. The photosensitive layer **159*a* of the photosensitive drum 159 was charged to −500 V by the corona charger 111', with an applied voltage at −5 kV, and a voltage form the grid 112' at −500 V. The laser beam scanning light 13 was projected onto the photosensitive layer 159*a* thus charged, thereby to form an electrostatic latent image thereon. The latent image thus formed was developed by the developing roller 117' supporting magenta 126M. At this time, D.C. voltage at −400 V was applied to the roller 117' by the high voltage source 118'**.

The image forming units 151BK, 151C, and 151Y other than the unit 151M for magenta have similar constructions for similar functions.

Referring back to FIG. 13, the construction of the printer section will be further described.

The image forming units 151BK, 151C, 151M and 151Y on disposed side by side can be displaced as a whole in the lateral direction (in a direction indicated by an arrow X) as driven by the displacing motor 30 for the displacing means, and the respective image forming units may be successively positioned near the image forming position 50 confronting the transfer section 33 where the belt 31 is slightly pushed up by the belt restricting member 32. Since the constructions for the displacement of the image forming units and positioning thereof are generally similar to those as described earlier with reference to the second embodiment of FIG. 7, detailed description thereof is abbreviated here for brevity. The constructions of the exposure section and transfer/transport belt are also similar to those in the second embodiment of FIG. 7.

Subsequently, functions of the above electrophotographic apparatus during formation of a color image in A4 size will be explained.

An A4 size paper sheet (not shown) fed from the paper feeding section 36 in a direction of width is held on the transfer/transport belt 31 while being attracted onto said belt 31 by the action of the adhering charger 37, and is displaced in the forward direction at a constant speed. In the first place, the image forming unit 151BK is disposed near the image forming position 50 for positioning so as to confront the transfer section 33. In timed relation with the paper sheet transported from the right side in FIG. 13 on the transfer/transport belt 31, a signal light for black is applied to the image forming unit 1BK by the laser exposure device 3, and thus, image formation by the black toner is effected.

Immediately after the trailing edge of the paper sheet has passed through the transfer section 33 upon completion of transfer of all the black toner image, the displacement of the belt 31 is once stopped and then, the belt 31 is displaced in the opposite direction.

Meanwhile, at approximately the same time as the starting of displacement of the belt 31 in the reverse direction, the positioning of the image forming unit 151BK is released, and 151BK, 151C, 151M and 151Y is driven by the displacing motor 30 as a whole and is moved leftward in FIG. 13 as one unit. Subsequently, the cyan signal is applied to the image forming unit 151C to effect formation and transfer of the cyan toner image.

The functions similar to the above are effected also for magenta and yellow, and on the paper sheet, toner images of four colors as positionally aligned are overlapped to form the resultant color image. After the last yellow toner image has been transferred, the belt 31 continuous to move in the forward direction as it is, and the paper sheet formed with the color image is fixed by the fixing device 44.

Described so far are the constructions and functions of the color electrophotographic apparatus C3 according to the third embodiment of the present invention.

It should be noted here that in the foregoing embodiments, although several specific developing methods have been described as adopted for the image forming units, the present invention is not limited in its essential concept and superior functions and effects thereof, even when other various developing methods are employed within the scope.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A color electrophotographic apparatus which comprises:

a plurality of movable image forming means each provided with a rotatable electrostatic latent image holding member and a developing means each having toner of different color, and capable of forming a toner image of different color on said electrostatic latent image holding member, a transfer and transport means capable of supporting thereon a transfer material so as to reciprocatingly move said transfer material, and provided with a transfer means for transferring the toner image on said electrostatic latent image holding member onto the transfer material at a single transfer position, an exposure means for effecting image exposure at a single exposure position corresponding to said transfer position, a displacing means for successively displacing each of said plurality of image forming means to an image forming position corresponding to said exposure position and also, to said transfer position, and a positioning means for positioning said image forming means which has moved to said image forming position, whereby the toner images of different colors are overlapped on the transfer material, with positions thereof aligned, thereby to effect the color image formation.

2. A color electrophotographic apparatus as claimed in claim 1, wherein said positioning means is adapted to position rotational center of the electrostatic latent image holding member for each of said image forming means.

3. A color electrophotographic apparatus as claimed in claim 1, wherein said image forming means located at said image forming position has a rotational center of the electrostatic latent image holding member thereof displaceably supported within a predetermined range.

4. A color electrophotographic apparatus which comprises:

a plurality of movable image forming means each provided with a rotatable electrostatic latent image holding member and a developing means each having toner of different color, and capable of forming a toner image of different color on said electrostatic latent image holding member, a transfer and transport means capable of supporting thereon a transfer material so as to reciprocatingly move said transfer material, and provided with a transfer means for transferring the toner image on said electrostatic latent image holding member onto the transfer material at a single transfer position, an exposure means for effecting image exposure at a single exposure position corresponding to said transfer position, a displacing means for successively displacing each of said plurality of image forming means to the vicinity of an image forming position corresponding to said exposure position and also, to said transfer position, and a positioning means for positioning said image forming means which is in the vicinity of said image forming position by displacing said image forming means to said image forming position, whereby the toner images of different colors are overlapped on the transfer material, with positions thereof aligned, thereby to effect the color image formation.

5. A color electrophotographic apparatus as claimed in claim 4, wherein said image forming means is so disposed as to become out of contact with said transfer and transport means in positions other than said image forming position.

6. A color electrophotographic apparatus which comprises:

a plurality of movable image forming means each provided with a rotatable electrostatic latent image holding member and a developing means each having toner of different color, and capable of forming a toner image of different color on said electrostatic latent image holding member, a supporting means for supporting said plurality of image forming means, a transfer means for transferring the toner image on said electrostatic latent image holding member onto the transfer material at a single transfer position, an exposure means for effecting image exposure at a single exposure position corresponding to said transfer position, a displacing means for displacing said support means so that each of said plurality of image forming means successively approaches an image forming position corresponding to said exposure position and also, to said transfer position, and a positioning means for positioning said image forming means which has approached said image forming position, whereby the toner images of different colors are overlapped on the transfer material, with positions thereof aligned, thereby to effect the color image formation.

7. A color electrophotographic apparatus as claimed in claim 6, wherein said support means supports each of said image forming means so that a rotational center of said electrostatic latent image holding member can be displaced within a predetermined range.

8. A color electrophotographic apparatus which comprises:

a plurality of movable image forming means each provided with a rotatable electrostatic latent image holding member and a developing means each having toner of different color, and capable of forming a toner image of different color on said electrostatic latent image holding member, a transfer and transport means capable of supporting thereon a transfer material so as to reciprocatingly move said transfer material, and provided with at transfer means for transferring the toner image on said electrostatic latent image holding member onto the transfer material at a single transfer position, a flywheel means which can be selectively connected to and spaced from said transfer and transport means, an exposure means for effecting image exposure at a single exposure position corresponding to said transfer position, a displacing means for successively displacing each of said plurality of image forming means to an image forming position corresponding to said exposure position and also, to said transfer position, whereby the toner images of different colors are overlapped on the transfer material, with positions thereof aligned, thereby to effect the color image formation.

9. A color electrophotographic apparatus as claimed in claim 8, further including a control means for connecting said flywheel means to the transfer and transport means when said transfer and transport means subjects the transfer material to going, and for spacing said flywheel means from said transfer and transport means when said transfer and transport means subjects the transfer material to returning.

10. A color electrophotographic apparatus which comprises:

a plurality of movable image forming means each provided with a rotatable photosensitive member and a developing means each having toner of different color, and capable of forming a toner image of different color on said photosensitive member, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position corresponding to said exposure position and also, to said transfer position, whereby the toner images of different colors are overlapped on the transfer material, with positions thereof aligned, thereby to effect the color image formation by fixing the color image of said transfer material by a heat fixing means, said plurality of image forming means being disposed in such an order that the image forming means for black is disposed in a position closest to the side of the heat fixing means in the horizontal direction.

11. A color electrophotographic apparatus as claimed in claim 10, wherein said image forming means for black is located at said image forming position during a standby period for the image forming functions of said color electrophotographic apparatus.

12. A color electrophotographic apparatus which comprises:

a plurality of movable image forming means each provided with rotatable photosensitive member, a charger for charging said photosensitive member, a developing material hopper for storing toner in different color, a developing means for developing said photosensitive member by said toner, and a cleaner for cleaning said photosensitive member, thereby to form toner images in different colors respectively on said photosensitive members, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position corresponding to said exposure position and also, to said transfer position, whereby the toner images of different colors are overlapped and transferred on the transfer material for color image formation, thereby to obtain the color images on said transfer material, part of said developing material hopper of said image forming means being arranged to utilize a space at the upper part of said charger of the neighboring image forming means.

13. A color electrophotographic apparatus as claimed in claim 12, wherein each of said image forming means has a side elevational shape generally in a parallelogram.

14. A color electrophotographic apparatus which comprises:

a plurality of movable image forming means each provided with a rotatable photosensitive member, a charger for charging said photosensitive member, a developing material hopper for storing toner in different color, a developing means for developing said photosensitive member by said toner, and a cleaner for cleaning said photosensitive member, thereby to form toner images in different colors respectively on said photosensitive members, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction to an image forming position corresponding to said exposure position and also, to said transfer position, whereby the toner images of different colors are overlapped and transferred on the transfer material for color image formation, thereby to obtain the color images on said transfer material, part of said developing material hopper of said image forming means being arranged to utilize a space at the upper part of said cleaner of the neighboring image forming means.

15. A color electrophotographic apparatus a claimed in claim 14, wherein each of said image forming means has a side elevational shape generally in a parallelogram.

16. A color electrophotographic apparatus which comprises:

a plurality of movable image forming means each provided with a rotatable photosensitive member and a developing means each having toner of different color, and capable of forming a toner image of different color on said photosensitive member, a transfer and transport means capable of supporting thereon a transfer material for reciprocating motion, and provided with a transfer means for transferring the toner image on said photosensitive member onto the transfer material at the same transfer position, an exposure means for effecting image exposure at the same exposure position corresponding to said transfer position, and a displacing means for successively displacing each of said plurality of image forming means which are disposed to be aligned side by side in a horizontal direction, to an image forming position corresponding to said exposure position and also, to said transfer position, whereby the toner images of different colors are overlapped and transferred onto the transfer material, thereby to effect the color image formation for obtaining color image on said transfer material, said neighboring color forming means being each formed into a shape which can be taken out slantwise upwardly.

17. A color electrophotographic apparatus as claimed in claim 16, wherein each of said image forming means has a side elevational shape generally in a parallelogram.

* * * * *